US008590883B2

(12) United States Patent
Asari et al.

(10) Patent No.: US 8,590,883 B2
(45) Date of Patent: Nov. 26, 2013

(54) SHEET HANDLING APPARATUS WITH SEPARATING MECHANISM TO SEPARATE THE SEPARABLE ROLLER PAIR

(75) Inventors: Yukio Asari, Kanagawa (JP); Toru Todoriki, Kanagawa (JP); Yusuke Mitsuya, Kanagawa (JP); Yoshihiko Naruoka, Kanagawa (JP); Naruaki Hiramitsu, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 138 days.

(21) Appl. No.: 13/224,526

(22) Filed: Sep. 2, 2011

(65) Prior Publication Data

US 2012/0068398 A1 Mar. 22, 2012

(30) Foreign Application Priority Data

Sep. 17, 2010 (JP) ..... 2010-209249

(51) Int. Cl.
*B65H 83/00* (2006.01)

(52) U.S. Cl.
USPC ..... 271/3.2; 271/265.02; 271/273

(58) Field of Classification Search
USPC ..... 271/273, 265.02, 3.14, 3.2
See application file for complete search history.

(56) References Cited

U.S. PATENT DOCUMENTS

| | | | | |
|---|---|---|---|---|
| 7,219,561 | B2 | 5/2007 | Okada | |
| 2006/0180971 | A1 | 8/2006 | Maruyama | |
| 2009/0115127 | A1 * | 5/2009 | Konig et al. | 271/265.04 |

FOREIGN PATENT DOCUMENTS

| | | | | |
|---|---|---|---|---|
| JP | 2002-263583 | A | 9/2002 | |
| JP | 2007156146 | A * | 6/2007 | B65H 5/06 |
| JP | A-2007-156146 | | 6/2007 | |
| WO | WO 2009/142042 | | 11/2009 | |

OTHER PUBLICATIONS

Extended European Search Report dated Jan. 15, 2013 in corresponding EP Application No. 11180287.2-1256.

* cited by examiner

*Primary Examiner* — Gerald McClain
(74) *Attorney, Agent, or Firm* — Posz Law Group, PLC

(57) ABSTRACT

According to one embodiment, a sheet handling apparatus includes a conveying path to convey a sheet, a processing portion to perform a predetermined process on the sheet while conveying the sheet on the conveying path, a separable roller pair that is arranged at a certain distance from the processing portion on an upstream side or a downstream side in conveying direction, the separable roller pair being adapted to hand over the sheet between the conveying path and the processing portion by holding the sheet with a nip and rotating, a separating mechanism to separate the separable roller pair, and a controller that controls the separating mechanism such that the separable roller pair is separated before or after processing is started with the processing portion on a sheet that is conveyed on the conveying path.

14 Claims, 26 Drawing Sheets

SHEET HANDLING APPARATUS WITH SEPARATING MECHANISM TO SEPARATE THE SEPARABLE ROLLER PAIR

CROSS-REFERENCE TO RELATED APPLICATION

This application is based upon and claims the benefit of priority from Japanese Patent Application No. 2010-209249, filed on Sep. 17, 2010, the entire contents of which are incorporated herein by reference.

FIELD

Exemplary embodiments described herein relate to a sheet handling apparatus that measures the weight of the sheets that are being conveyed consecutively or that corrects the gap between the trailing edge of a preceding sheet and the leading edge of the following sheet while the sheets are being conveyed.

BACKGROUND

Mail handling apparatuses include, for example, a weight measuring apparatus that measures the weight of mail items that are conveyed consecutively. In order to measure the weight of each mail item in a state in which it is unaffected by conveying systems on its upstream side and its downstream side, the weight measuring apparatus is built into the mail handling apparatus as a unit that is independent from the conveying systems. The mail items to be processed have different lengths in conveying direction.

In order to reliably hand over and convey the mail items to this independent unit, the distance between the weight measuring apparatus and the conveying rollers that are closest to the unit on the upstream side in conveying direction of the weight measuring apparatus (these conveying rollers are referred to in the following as "upstream-side conveying rollers") is set to a distance that is shorter than the mail item with the shortest length in conveying direction out of the mail items that are handled by the mail handling apparatus (such a mail item is referred to in the following as "shortest mail item"). The length of the shortest mail item, as the shortest sheet, may be 14 cm in Japan, for example. The length of the shortest mail item differs for every country. Similarly, also the distance between the weight measuring apparatus and the conveying rollers that are closest to the unit on the downstream side in conveying direction of the weight measuring apparatus (these conveying rollers are referred to in the following as "downstream-side conveying rollers") is set to be shorter than the shortest mail item.

Moreover, in order to enable the weight measurement of the mail item whose length is longest in conveying direction out of the mail items that are handled by the mail handling apparatus (such a mail item is referred to in the following as "longest mail item"), it is necessary that the distance between the upstream-side conveying rollers and the downstream-side conveying rollers is longer than at least the length in conveying direction of the longest mail item. That is to say, when measuring the weight of a mail item, it is necessary that that mail item is unaffected by the conveying systems on the upstream side and on the downstream side. The length of the longest mail item, as the longest sheet, may be 23.5 cm in Japan, for example. The length of the longest mail item differs for every country.

Thus, it is necessary that the distance between the upstream-side conveying rollers and the downstream-side conveying rollers is sufficiently long, so that the weight measurement is finished in the time after the trailing edge in conveying direction of the longest mail item that is fed into the weight measuring apparatus has left the nip of the upstream-side conveying rollers and the conveying state of that longest mail item has stabilized until the leading edge in conveying direction of that longest mail item reaches the downstream-side conveying rollers.

However, when the distance between the upstream-side conveying rollers and the downstream-side conveying rollers is made large, the length of the weight measuring apparatus in conveying direction necessarily also needs to be made large, which is problematic for example in cases where the shortest mail item is conveyed consecutively. That is to say, when the shortest mail items are conveyed consecutively with a short gap in order to achieve fast processing, a plurality of the shortest mail items will be fed simultaneously into the weight measuring apparatus, and it is not possible anymore to measure the weight of the mail items.

While it is conceivable to widen the conveying gap of the mail items, in this case the number of mail items conveyed per unit time becomes accordingly lower, and the processing capability of the mail handling apparatus drops. That is to say, in this case, high-speed processing of mail items is not possible anymore.

On the other hand, a method is conceivable in which drops in the processing capability are averted by branching the conveying path of the mail items, arranging a plurality (for example two) weight measuring apparatuses in parallel, and guiding the mail items alternatingly to these measuring apparatuses. However, in this case, the manufacturing costs of the apparatus increase, and also the installation space for the apparatuses increases.

DETAILED DESCRIPTION

In general, according to one embodiment, there is provided a sheet handling apparatus including: a conveying path to convey a sheet; a processing portion to perform a predetermined process on the sheet while conveying the sheet on the conveying path; a separable roller pair that is arranged at a certain distance from the processing portion on an upstream side or a downstream side in conveying direction, the separable roller pair being adapted to hand over the sheet between the conveying path and the processing portion by holding the sheet with a nip and rotating; a separating mechanism to separate the separable roller pair; and a controller that controls the separating mechanism such that the separable roller pair is separated before or after processing is started with the processing portion on the sheet that is conveyed on the conveying path.

Figure 1:
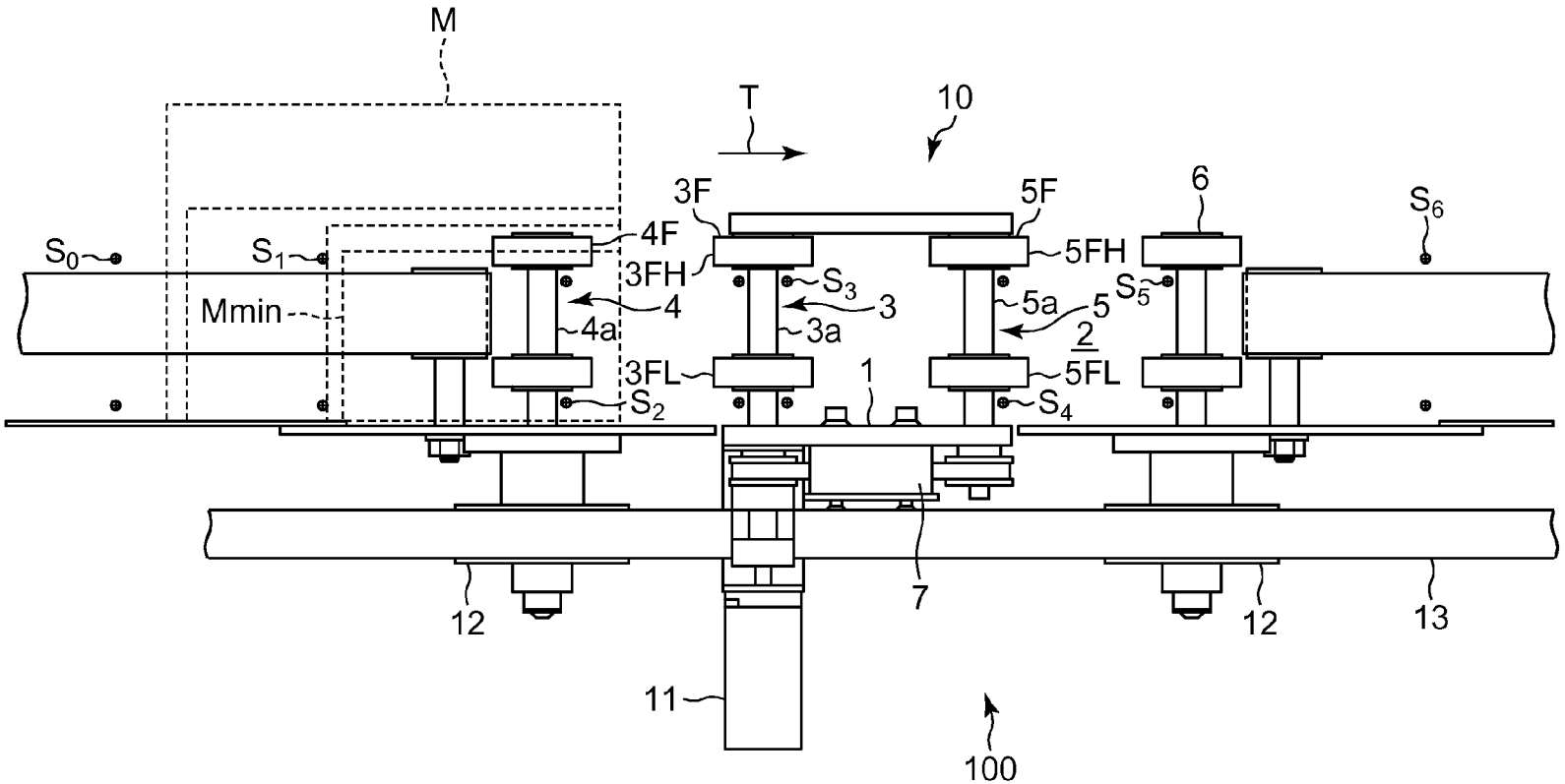
FIG. 1 is a front view of a mail handling apparatus according to a first embodiment.
Figure 2:
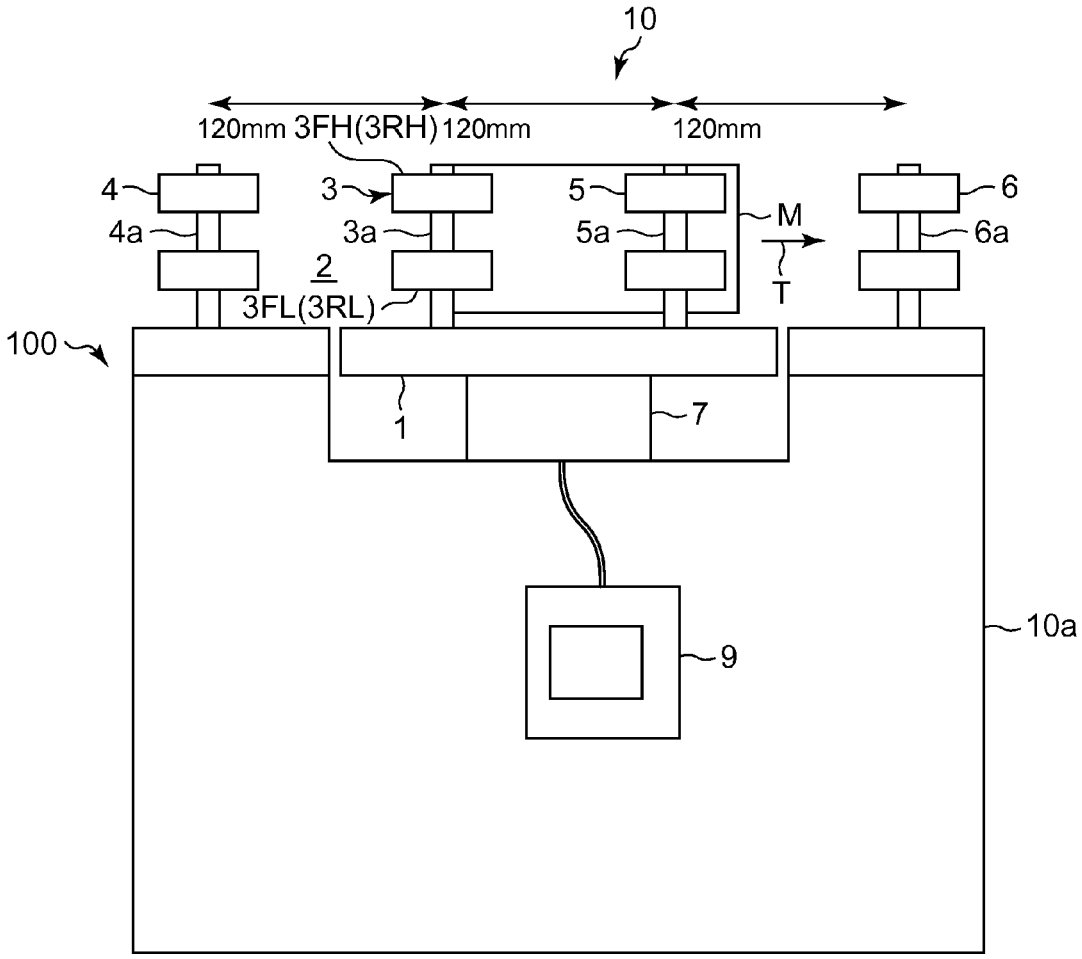
FIG. 2 is a diagrammatical view of the handling apparatus in FIG. 1.
Figure 3:
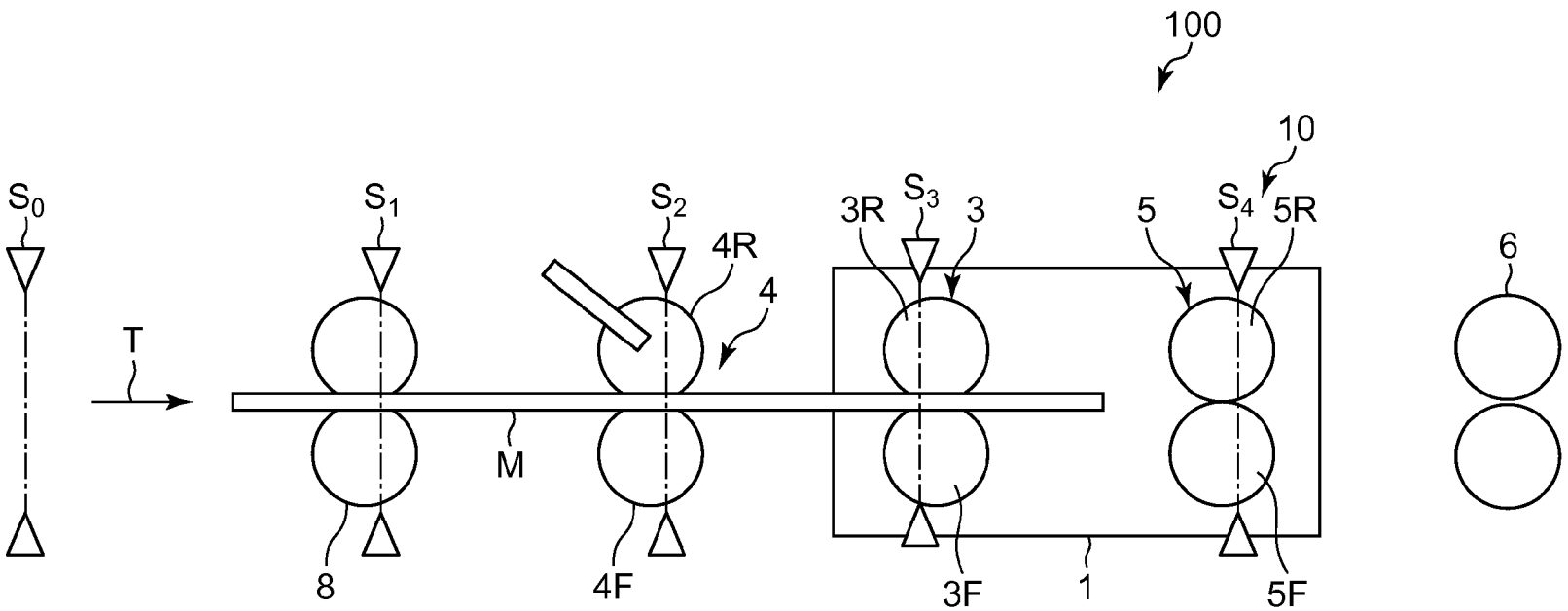
FIG. 3 is a top view of the handling apparatus in FIG. 1.
Figure 4:
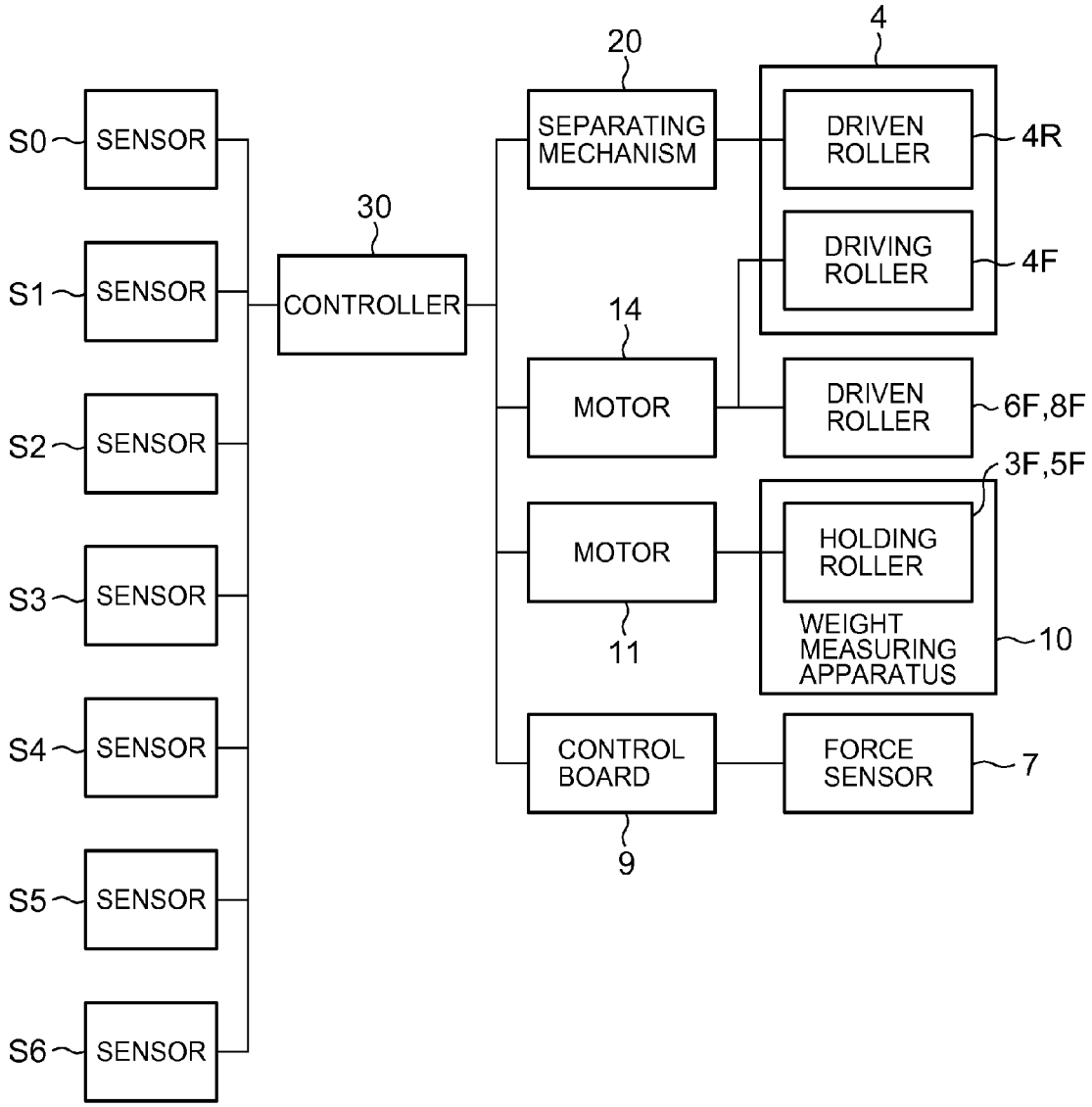
FIG. 4 is a block diagram of the control system controlling the operation of the handling apparatus in FIG. 1.

Referring to the accompanying drawings, the following is a detailed explanation of one embodiment. FIG. 1 is a front view showing, as an example of a sheet handling apparatus, the structure of the principal parts of a mail handling apparatus 100 (referred to below simply as "handling apparatus 100") according to a first embodiment, as viewed from the side. FIG. 2 shows a diagrammatical view of the handling apparatus 100 in FIG. 1, and FIG. 3 shows a top view of the handling apparatus 100 in FIG. 1, as viewed from above. Moreover, FIG. 4 shows a block diagram of the control system controlling the operation of the handling apparatus 100 in FIG. 1. Here, an apparatus that handles mail items M serving as sheets is explained, but the sheets to be handled are not limited to mail items M.

The handling apparatus 100 of this embodiment includes a weight measuring apparatus 10 (processing portion) through which mail items M (sheets) that are conveyed consecutively in an upright orientation in arrow direction T are passed along a conveying path 2, and measures the weight of the mail items M. Moreover, the handling apparatus 100 includes an upstream-side separable roller pair 4 at a position that is spaced apart by a certain distance from the weight measuring apparatus 10 on the upstream side in conveying direction of the weight measuring apparatus 10. A separable roller pair is a roller pair that can be switched, e.g. by a separating mechanism, between two states, namely a first state in which the two rollers of the roller pair are in contact with each other forming a nip, and a second state in which the two rollers of the roller pair are spaced apart (i.e. separated), such that they impart substantially no force on a sheet or mail item passing between them. Furthermore, the handling apparatus 100 includes a downstream-side conveying roller pair 6 at a position that is spaced apart by a certain distance from the weight measuring apparatus 10 on the downstream side in conveying direction of the weight measuring apparatus 10. It should be noted that an upstream-side conveying roller pair 8 (shown only in FIG. 3) is arranged at a position that is spaced apart by a certain distance from the upstream-side weight measuring apparatus 10 further on the upstream side of the upstream-side separable roller pair 4.

That is to say, the mail items M that are fed consecutively into the handling apparatus 100 are conveyed at a certain speed in the arrow direction T on the conveying path 2, and pass along the upstream-side conveying roller pair 8, the upstream-side separable roller pair 4, the weight measuring apparatus 10, and the downstream-side conveying roller pair 6 in that order. In order to stabilize their conveying orientation, the mail items M are conveyed in their longitudinal direction. As explained further below, the weight measuring apparatus 10 is arranged to be mechanically independent from the upstream-side and the downstream-side conveying systems of the handling apparatus 100. Therefore, the weight of the mail items M fed into the weight measuring apparatus 10 can be measured with high precision without being affected by the conveying systems.

The weight measuring apparatus 10 includes two holding roller pairs 3 and 5 that convey a mail item M in the arrow direction T on the conveying path 2, while restraining the mail item M by rotating while clamping the mail item M in the nip. The respective rotation shafts 3*a* and 5*a* of the two holding roller pairs 3 and 5 are arranged in the vertical direction and their lower ends are held rotatively by a base plate 1 that extends in the horizontal direction. Moreover, the two holding roller pairs 3 and 5 each include two roller portions that are spaced apart vertically along the rotation shafts 3*a* and 5*a*. These two holding roller pairs 3 and 5 have substantially the same structure.

To explain the structure of the holding roller pair 3 on the upstream side in conveying direction in more detail, a holding roller 3F that is arranged on the front side of the apparatus with respect to the conveying path 2 (below the conveying path in FIG. 3) includes two roller portions 3FL and 3FH that are made of solid rubber rollers that are spaced apart vertically along the rotation shaft 3*a*. A motor 11 is connected to the rotation shaft 3*a* of the front-side holding roller 3F, and this holding roller 3F functions as a driving roller. It should be noted that also the rotation shaft 5*a* of the holding roller 5F on the front side of the downstream-side holding roller pair 5 is connected to this motor 11, and also this holding roller 5F functions as a driving roller.

Also the holding roller 3R that is arranged on the rear side of the apparatus with respect to the conveying path 2 (above the conveying path in FIG. 3) includes two roller portions 3RL and 3RH that are spaced apart vertically along the rotation shaft 3*a*. These two roller portions 3RL and 3RH are arranged such that they respectively contact the outer circumferential surfaces of the two roller portions 3FL and 3FH of the opposing holding roller 3F across the conveying path 2. The two roller portions 3RL and 3RH each have a two-layer structure including a sponge layer on the outer side of their metal core, and a rubber layer as the outermost layer. The rear-side holding roller 3R functions as a driven roller that follows the front-side holding roller 3F. It should be noted that also the rear-side holding roller 5R of the holding roller pair 5 on the downstream-side functions as a driven roller that contacts and follows the rotation of the front-side holding roller 5F.

That is to say, in this pair of holding rollers 3F and 3R (5F and 5R), the respective rotation shafts 3*a* are held rotatively with respect to the base plate 1, so that their axial distance is constant, and in order to allow the mail items M that are fed between the two to pass through them, the roller portion of at least one of the holding rollers should be elastically deformable. Therefore, in the present embodiment, an elastically deformable roller with two-layer structure is used for the rear-side holding roller 3R. It should be noted that also the holding roller pair 5 on the downstream side has the same structure as the holding rollers 3 on the upstream side, so that its further detailed explanation is omitted.

That is to say, the weight of the mail items M that are being conveyed while clamped in the nip of the two holding roller pairs 3 and 5 is supported by the base plate 1. In the present embodiment, the base plate 1 of the weight measuring apparatus 10 is independent from the conveying systems, so that if no external force from the surrounding conveying systems acts on the mail item M that is being held by any of the holding rollers 3 and 5, then the weight of the mail item M can be measured accurately through the base plate 1.

That is to say, as shown in FIG. 2, the weight measuring apparatus 10 includes a force sensor 7 (see U.S. Pat. No. 7,219,561) at a position where the base plate 1 is supported by a casing 10*a* of the apparatus. Moreover, this force sensor 7 is connected to a control board 9. The weight of the mail items M passing through the weight measuring apparatus 10 is detected by the control board 9 via the force sensor 7.

The upstream-side separable roller pair 4 that is arranged on the upstream side of the weight measuring apparatus 10 includes a driving roller 4F that is arranged on the front side of the apparatus with respect to the conveying path 2, and a driven roller 4R that is arranged on the rear side of the conveying path 2 such that it can be separated from the driving roller 4F.

The driving roller 4F has substantially the same structure as the holding roller 3F on the front side of the above-described weight measuring apparatus 10, and the driving force of a motor 14 is transmitted to its rotation shaft 4*a* via a plurality of pulleys 12 and timing belts 13. It should be noted that the driving force of this motor 14 is transmitted also to a front-side driving roller 6F of the downstream-side conveying roller pair 6 and a front-side driving roller 8F of the upstream-side conveying roller pair 8, which are explained later.

Figures 5A, 5B, 5C, 5D, 5E:
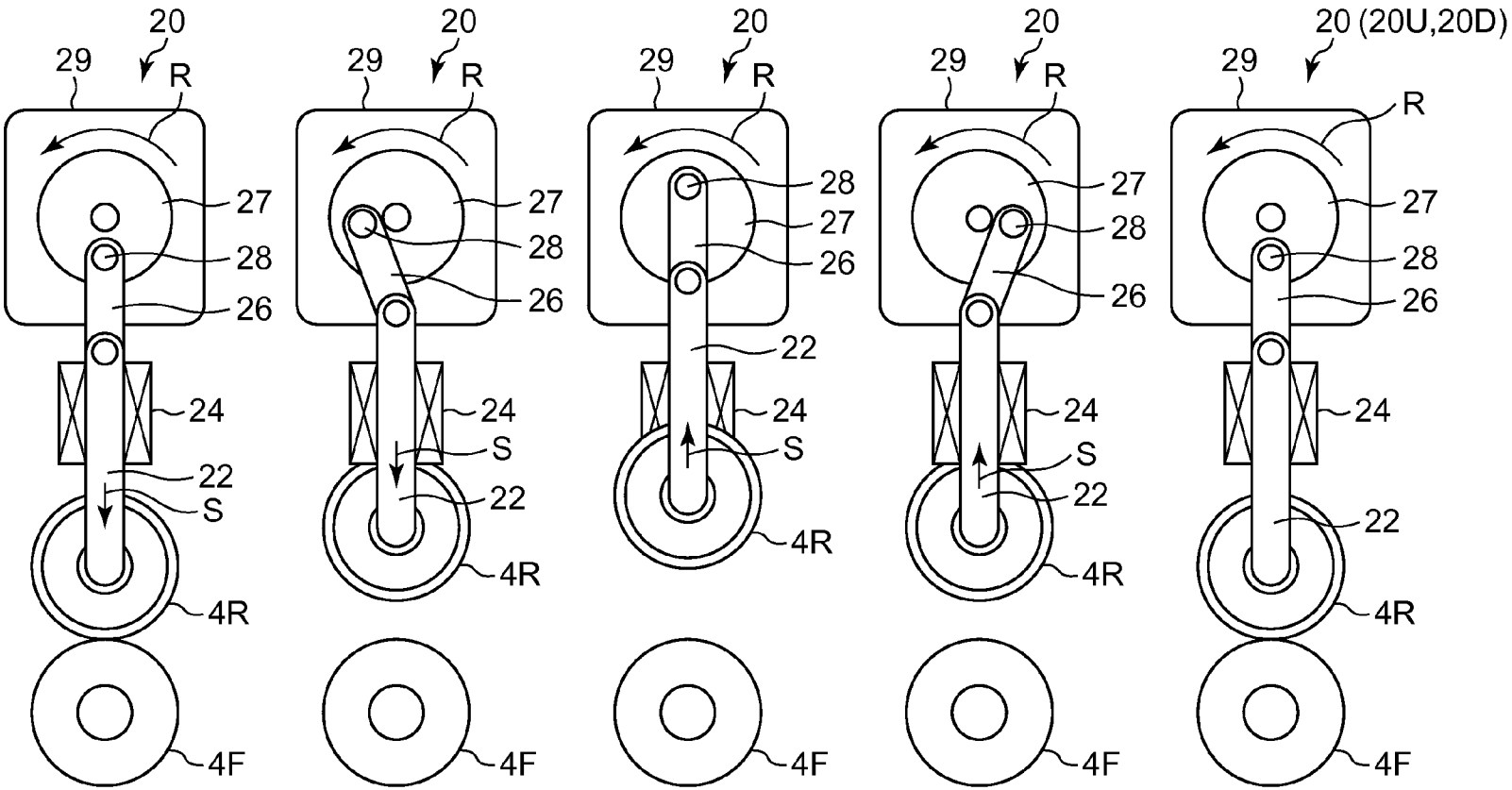
FIGS. 5A to 5E are operation diagrams illustrating the operation of the upstream-side separable roller pair in FIG. 3.

On the other hand, the rear-side driven roller 4R of the upstream-side separable roller pair 4 has substantially the same structure as the rear-side holding roller 3R of the above-described weight measuring apparatus 10, and is attached in such a manner that it can be moved by a later-described separating mechanism 20 (FIG. 5) in a direction separating it with respect to the conveying path 2. That is to say, in a state in which this separating mechanism 20 is operated and the driven roller 4R contacts the driving roller 4F, a conveying force can be imparted on the mail item M, and in a state in which the driven roller 4R is spaced apart from the driving roller 4F, no conveying force can be imparted on the mail item M.

Furthermore, the downstream-side conveying roller pair 6 that is arranged on the downstream side of the weight measuring apparatus 10 and the upstream-side conveying roller pair 8 that is arranged further on the upstream side of the upstream-side separable roller pair 4 have substantially the same structure as the holding roller pairs 3 and 5 of the above-described weight measuring apparatus 10. Therefore, their detailed explanation has been omitted.

As shown in FIG. 4, a plurality of sensors S0 to S6 that are spaced apart along the conveying path 2 are connected to a controller 30 that controls the operation of the handling apparatus 100. Each of the sensors includes a light-emitting portion and a light-receiving portion that are respectively arranged at positions on opposite sides of the conveying path 2. Moreover, the sensors are arranged at such positions that the optical axis connecting the light-emitting portion with the light-receiving portion intersects the conveying path 2.

In the present embodiment, as shown in FIG. 1, each of the sensors S0 to S6 includes two sensors, namely a sensor whose optical axis passes near the lower edge of the mail items M and a sensor whose optical axis passes near the middle or the upper edge of the mail items M. The controller 30 senses the passage of a mail item M as a result of the optical axis of the sensors being blocked by the mail item M. That is to say, the sensors sense the passage of the front edge in conveying direction and the rear edge in conveying direction of the mail items M at their respective positions.

The sensor S0, which is arranged furthest upstream on the conveying path 2, is arranged at such a position that its optical axis intersects the conveying path 2 at a position at a distance on the upstream side in conveying direction from the nip of the upstream-side conveying roller pair 8. Moreover, the sensor S1 next to this sensor S0 on the downstream side in conveying direction is arranged such that its optical axis intersects the conveying path 2 near the nip of the upstream-side conveying roller pair 8. Also, the sensor S2 next to this sensor S1 on the downstream side in conveying direction is arranged such that its optical axis intersects the conveying path 2 near the nip of the upstream-side separable roller pair 4. Also, the sensor S3 next to this sensor S2 on the downstream side in conveying direction is arranged such that its optical axis intersects the conveying path 2 near the nip of the holding roller pair 3 on the upstream side of the weight measuring apparatus 10. Also, the sensor S4 next to this sensor S3 on the downstream side in conveying direction is arranged at such a position that its optical axis intersects the conveying path 2 near the nip of the holding roller pair 5 on the downstream side of the weight measuring apparatus 10. Furthermore, the sensor S5 next to this sensor S4 on the downstream side in conveying direction is arranged at such a position that its optical axis intersects the conveying path 2 near the nip of the downstream-side conveying roller pair 6.

The controller 30 is connected to the motor 14 for driving the driving roller 4F of the upstream-side separable roller pair 4, the driving roller 6F of the downstream-side conveying roller pair 6 and the driving roller 8F of the upstream-side conveying roller pair 8, the motor 11 for driving the holding roller 3F on the front side of the upstream-side holding roller pair 3 and the holding roller 5F on the front side of the downstream-side holding roller pair 5 of the weight measuring apparatus 10, the separating mechanism 20 (upstream-side separating mechanism) for separating the driven roller 4R of the upstream-side separable roller pair 4 from the driving roller 4F, and the control board 9 controlling the force sensor 7 of the weight measuring apparatus 10.

In the present embodiment, in order to hand over mail items M between the plurality of roller pairs 8, 4, 3, 5 and 6 that are arranged along the conveying path 2, the distance between the nips among adjacent roller pairs is set in accordance with the size of the mail items whose length in conveying direction is shortest out of the mail items M that are processed by the handling apparatus 100 (in the following, these mail items are referred to as "shortest mail items Mmin"). Here, the length in conveying direction of the shortest mail item Mmin is set to 127 mm.

More specifically, as shown in FIG. 2, in the present embodiment, the distance between the nips of the roller pairs 4, 3, 5 and 6 that are spaced apart at a certain distance along the conveying path 2 is set to 120 mm. Thus, by making the distance between the nips shorter than the length of the shortest mail item Mmin in conveying direction, it is possible to hand over any mail item M among the roller pairs, regardless of the length of the conveyed mail item M, and all mail items M can be conveyed reliably. That is to say, the length in conveying direction from the nip of the upstream-side separable roller pair 4 to the nip of the downstream-side conveying roller pair 6 is set to be shorter than three times the length Mmin of the shortest mail item in conveying direction.

However, if there is a weight measuring apparatus 10 in an intermediate section of the conveying path 2, as in the case of the handling apparatus 100 of the present embodiment, when the distance between the nips of the plurality of roller pairs for handing over and conveying the mail items M is shortened in accordance with the shortest mail item Mmin, an external force from the conveying mechanisms on the upstream-side and/or downstream-side of the weight measuring apparatus 10 tends to be imparted on the mail item M whose weight is being measured, and there is the possibility that precise weight measurement is not possible anymore. In particular, if the weight of the mail items whose length in conveying direction is longest, out of the mail items M that are processed by the handling apparatus 100 (in the following such a mail item is referred to as "longest mail item Mmax") is measured, then the time for which this longest mail item Mmax is held only by the weight measuring apparatus 10 becomes very short, and the necessary calculation time that is required by the weight measurement cannot be ensured anymore.

Therefore, in the present embodiment, the roller pair that is arranged next to the upstream side of the weight measuring apparatus 10 can be separated with respect to the conveying path 2. The structure and the operation of the separating mechanism 20 of the upstream-side separable roller pair 4 is explained with reference to FIG. 5.

The separating mechanism 20 includes a slide arm 22, a sleeve 24, a cam arm 26, a support pin 28 and a motor 29. One end of the slide arm 22 is rotatively attached to the rotation shaft 4*a* of the rear-side driven roller 4R of the upstream-side separable roller pair 4. The sleeve 24 supports this slide arm 22 movably in the direction of the arrow S in the drawing (in the direction in which the rotation shafts of the driving roller 4F and the driven roller 4R are lined up). One end of the cam arm 26 is turnably linked to the other end of the slide arm 22. The other end of the cam arm 26 is turnably linked to the support pin 28 at a position that is shifted from the center of a rotation plate 27. The motor 29 rotates this rotation plate 27.

Now, when the motor 29 is rotated in the direction of the arrow R in the drawing, then the other end of the cam arm 26 is rotated by rotating the rotation plate 27 once as shown in FIGS. 5A to 5E, and the slide arm 22 coupled to the front end of the cam arm 26 slides in the direction of the arrow S along the sleeve 24. Thus, the driven roller 4R can be separated from the driving roller 4F. Here, a motor is used for the separating mechanism 20 for separating the driven roller 4R from the driving roller 4F, but it is also possible to use another actuator, such as a solenoid, for example.

Figure 6A:
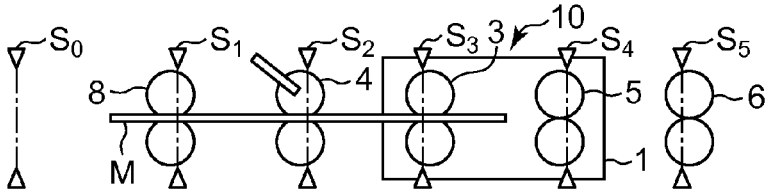
FIGS. 6A to 6H are operation diagrams illustrating the operation of the handling apparatus in FIG. 1.
Figure 6B:
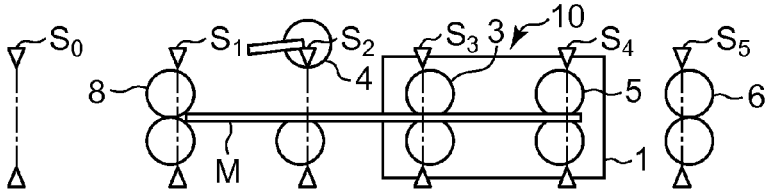
Figure 6C:
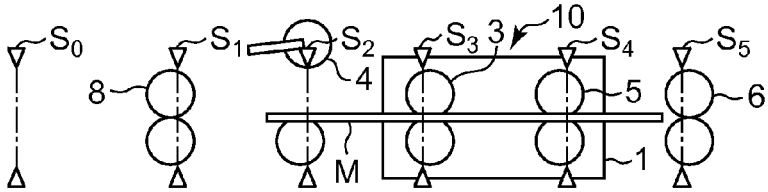
Figure 6D:
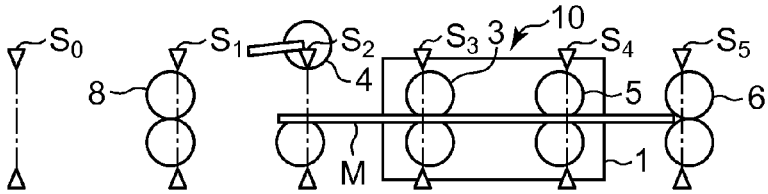
Figure 6E:
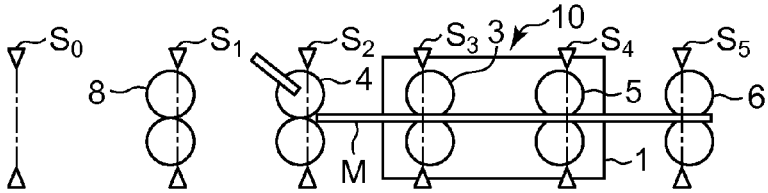
Figure 6F:
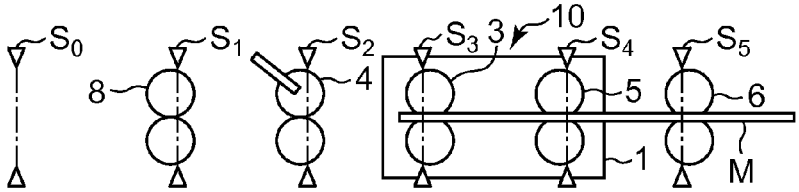
Figure 6G:
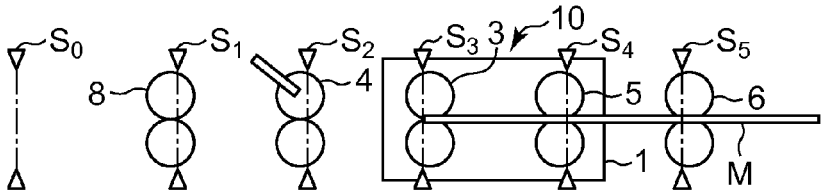
Figure 6H:
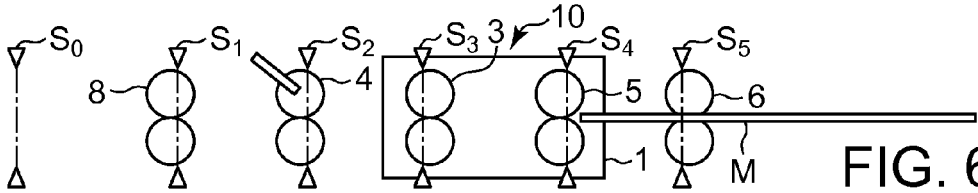
Figure 7:
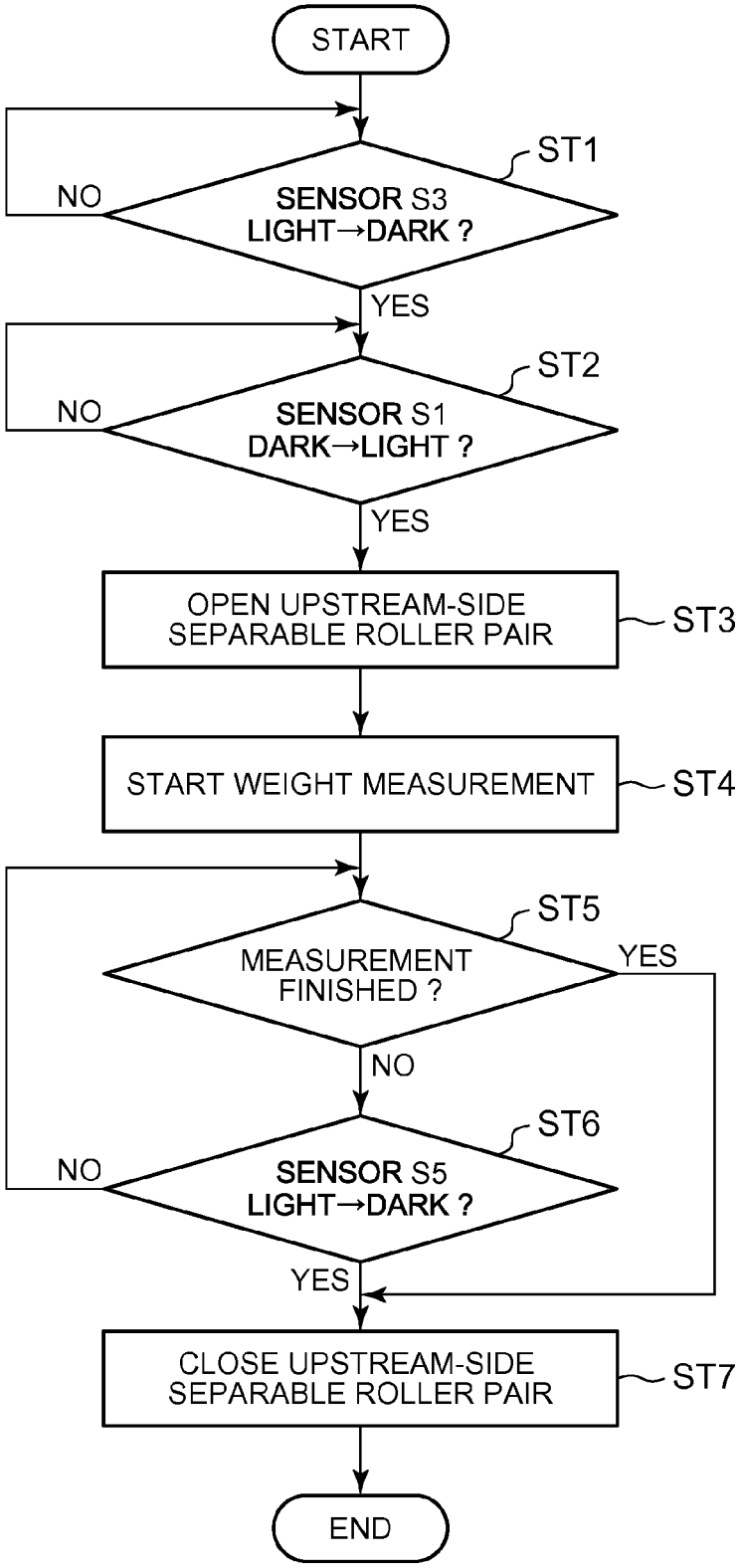
FIG. 7 is a flowchart illustrating the operation of the handling apparatus in FIG. 1 together with FIG. 6.

Referring to the FIGS. 6 and 7, the following is an explanation of the operation of the above-explained handling apparatus 100. FIG. 6 is an operation diagram illustrating the operation of the handling apparatus 100, and FIG. 7 is a flowchart illustrating the operation of the handling apparatus 100.

In a standby state prior to the mail item M being fed into the handling apparatus 100, the controller 30 rotates the motor 29 of the separating mechanism 20 such that the driven roller 4R of the upstream-side separable roller pair 4 contacts the driving roller 4F. Moreover, in the standby state, the controller 30 causes the motors 11 and 14 to rotate, thus rotating the two holding roller pairs 3 and 5 of the weight measuring apparatus 10, the upstream-side conveying roller pair 8, the upstream-side separable roller pair 4 and the downstream-side conveying roller pair 6 at constant speed. It should be noted that the controller 30 monitors the conveying position of the mail item M that is fed on the conveying path 2 to the handing apparatus 100 based on the output of the plurality of sensors S0 to S6.

Moreover, as a preparation before measuring the weight of the conveyed mail item M, the controller 30 measures the weight of the weight measuring apparatus 10 with the force sensor 7. That is to say, the controller 30 measures, in advance, the weight of the weight measuring apparatus 10 when no mail item M is being conveyed, and measures the weight of the mail item M by subtracting this from the weight of the weight measuring apparatus 10 when the mail item M is being conveyed.

When a plurality of mail items M is conveyed consecutively on the conveying path 2 and fed into the handling apparatus 100, then, based on the output of the sensor S3, the controller 30 first judges whether the mail item M to be processed is clamped by the nip of the holding roller pair 3 on the upstream side of the weight measuring apparatus 10 (FIG. 7, Step 1). For example, in the state in FIG. 6A, the leading edge in conveying direction of the mail item M has already passed the nip of the holding roller pair 3.

If it is judged in Step 1 that the leading edge in conveying direction of the mail item M is held by the weight measuring apparatus 10 (Step 1: YES), then the controller 30 judges, based on the output of the sensor 51, whether the trailing edge in conveying direction of the mail item M has passed the nip of the upstream-side conveying roller pair 8 (Step 2). For example, if the mail item is a shortest mail item Mmin, then, at the point in time when it is sensed in Step 1 that the leading edge in conveying direction of the shortest mail item Mmin is held by the holding roller pair 3, the trailing edge in conveying direction of the shortest mail item Mmin has already passed the nip of the upstream-side conveying roller pair 8.

If it is judged in Step 2 that the trailing edge in conveying direction of the mail item M has passed the nip of the upstream-side conveying roller pair 8 (Step 2: YES), then the controller 30 causes the motor 29 of the separating mechanism 20 to rotate, to space apart the driven roller 4R of the upstream-side separable roller pair 4 from the driving roller 4F and open the upstream-side separable roller pair 4 (Step 3). This state is shown in FIG. 6B.

Then, after the controller 30 has opened the upstream-side separable roller pair 4 in Step 3, the weighing of the weight of the mail item M with the force sensor 7 of the weight measuring apparatus 10 is started (Step 4). While the weight of the mail item M is being measured, the mail item M is conveyed, as shown in FIGS. 6B to 6D. In the states shown in FIGS. 6B, 6C and 6D, there are no other roller pairs clamping the mail item M other than the two holding roller pairs 3 and 5 of the weight measuring apparatus 10, so that the weight of the mail item M can be measured with high precision without imparting an undesired force from outside on the mail item M.

After this, based on the output of the sensor S5, the controller 30 judges whether the front edge in conveying direction of the mail item M is clamped in the nip of the downstream-side conveying roller pair 6 (Step 6). Then, if it is judged in Step 6 that the front edge in conveying direction of the mail item M is clamped by the nip of the downstream-side conveying roller pair 6 (state in FIG. 6E) (Step 6: YES), or measuring the weight of the mail item M has finished (Step 5: YES), then the controller 30 rotates the motor 29 of the separating mechanism 20 such that the upstream-side separable roller pair 4 is closed (Step 7).

As described above, with the present embodiment, the controller 30 opens the upstream-side separable roller pair 4 as in Step 3 at the point in time when it is judged in Step 2 that the trailing edge in conveying direction of the mail item M has passed the nip of the upstream-side conveying roller pair 8, so that the measurement of the weight of the mail item M can be started before the trailing end in conveying direction of the mail item M passes the nip of the upstream-side separable roller pair 4 (from the point in time of FIG. 6B).

That is to say, with the present embodiment, a shortest mail item Mmin can be reliably handed over to the holding roller pair 3 on the upstream side of the weight measuring apparatus 10 by closing the upstream-side separable roller pair 4, and if for example the weight of a longest mail item Mmax is to be measured, then the weight measurement can be started at a timing that is earlier than usual (that is, if there is no opening and closing of the upstream-side separable roller pair 4) by opening the upstream-side separable roller pair 4 at the above-described timing, so that the necessary processing time for the weight measurement can be ensured. Thus, a weight measurement with higher precision becomes possible.

Moreover, with the present embodiment, since it is sufficient to make the simple configurational change of enabling opening and closing of the roller pair (the upstream-side separable roller pair 4 in the present embodiment) that is next to the weight measuring apparatus 10 on the upstream side in conveying direction, a large-scale redesign of the apparatus is unnecessary, so that also the manufacturing costs of the apparatus can be kept low.

With the present embodiment, if the weight measurement of the mail item M is finished before the controller 30 has sensed in Step 6 that the leading edge in conveying direction of the mail item M has reached the nip of the downstream-side conveying roller pair 6 (Step 6: NO; Step 5: YES), then the upstream-side separable roller pair 4 is closed at this point in time, so that the mail items M can be reliably conveyed in a stable manner. That is to say, if the weight measurement of the mail item M is finished, then the measurement result is unaffected, even if a force is exerted from outside on the mail item M.

Furthermore, with the present embodiment, if the trailing edge in conveying direction of the mail item M passes the upstream-side separable roller pair 4 after the upstream-side separable roller pair 4 has been closed in Step 7, then it becomes immediately possible to hand over the next mail item M to the upstream-side separable roller pair 4, so that there is no necessity to widen the gap between the mail items M, and there is no necessity to branch the conveying path into two directions and to provide two weight measuring apparatuses 10 in parallel, so that the installation space of the apparatus does not become large.

Figure 8:
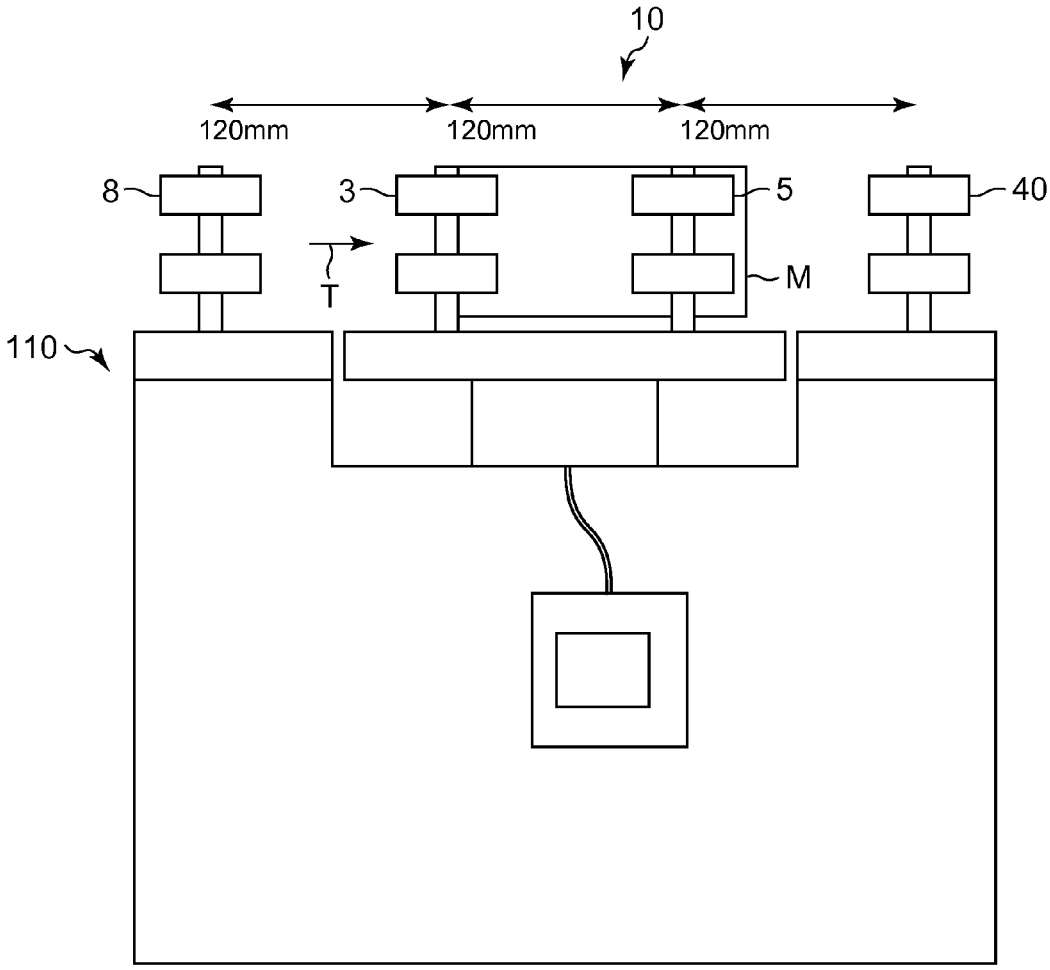
FIG. 8 is diagram, viewed from the front, of a mail handling apparatus according to a second embodiment.

FIG. 8 is a diagrammatical view, taken from the front and corresponding to FIG. 2, of a mail handling apparatus 110 according to a second embodiment (referred to below simply as "handling apparatus 110"). In this handling apparatus 110 according to the second embodiment, the upstream-side conveying roller pair 8 is arranged at the position of the upstream-side separable roller pair 4 of the above-described handling apparatus 100 of the first embodiment, a downstream-side separable roller pair 40 is newly provided at the position of the downstream-side conveying roller pair 6 of the handling apparatus 100 of the first embodiment, and the downstream-side conveying roller pair 6 (not shown in the drawings) is arranged further on the downstream side of the downstream-side separable roller pair 40. Otherwise, the handling apparatus 110 has the same configuration as the handling apparatus 100 of the above-described first embodiment. Thus, structural elements having the same function as those in the above-described handling apparatus 100 of the first embodiment are assigned the same reference numerals and their further explanation has been omitted.

That is to say, a mail item M that is conveyed on the conveying path 2 of this handling apparatus 110 in the arrow direction T in the drawing is passed along the upstream-side conveying roller pair 8, the upstream-side holding roller pair 3 of the weight measuring apparatus 10, the downstream-side holding roller pair 5 of the weight measuring apparatus 10, the downstream-side separable roller pair 40, and the downstream-side conveying roller pair 6 in that order.

It should be noted that the downstream-side separable roller pair 40 has substantially the same structure as the above-described upstream-side separable roller pair 4, and is opened and closed by a separating mechanism 20 (downstream-side separating mechanism) that is similar to that in the above-described first embodiment. Moreover, also in the present embodiment, the distance between the nips of the roller pairs 8, 3, 5, 40 and 6 that are lined up along the conveying path 2 is set to 120 mm. That is to say, the length in conveying direction from the nip of the upstream-side conveying roller pair 8 to the nip of the downstream-side separable roller pair 40 is shorter than three times the length in conveying direction of the shortest sheet Mmin.

Figure 9A:
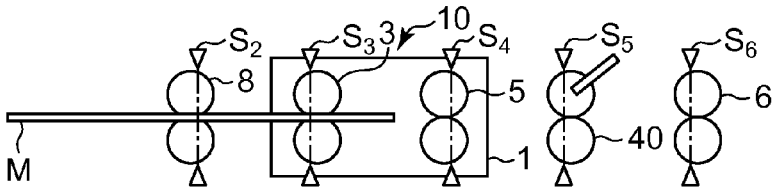
FIGS. 9A to 9H are operation diagrams illustrating the operation of the handling apparatus in FIG. 8.
Figure 9B:
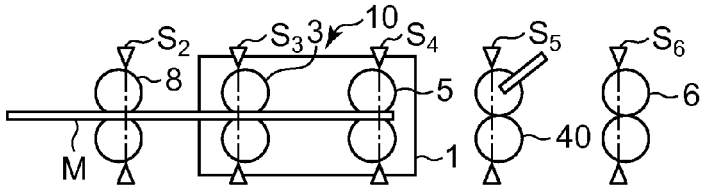
Figure 9C:
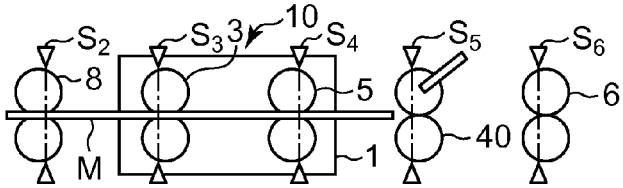
Figure 9D:
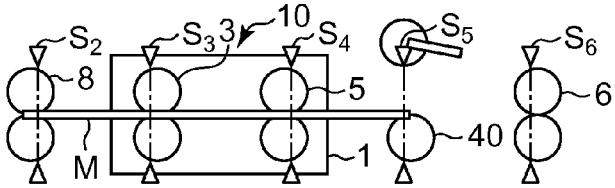
Figure 9E:
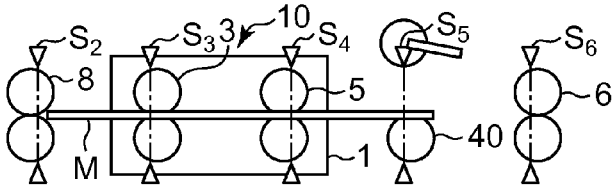
Figure 9F:
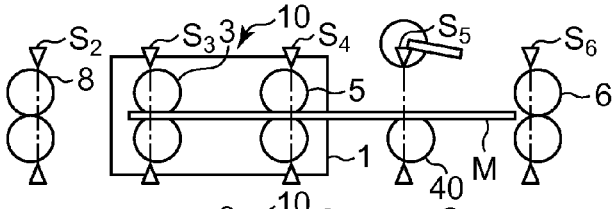
Figure 9G:
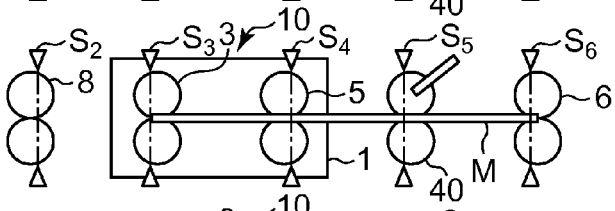
Figure 9H:
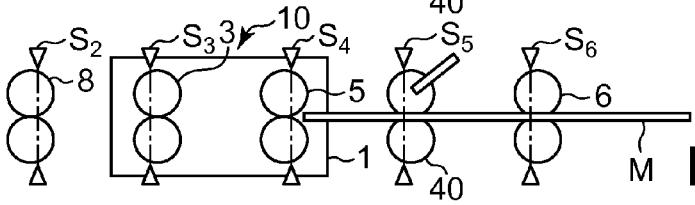
Figure 10:
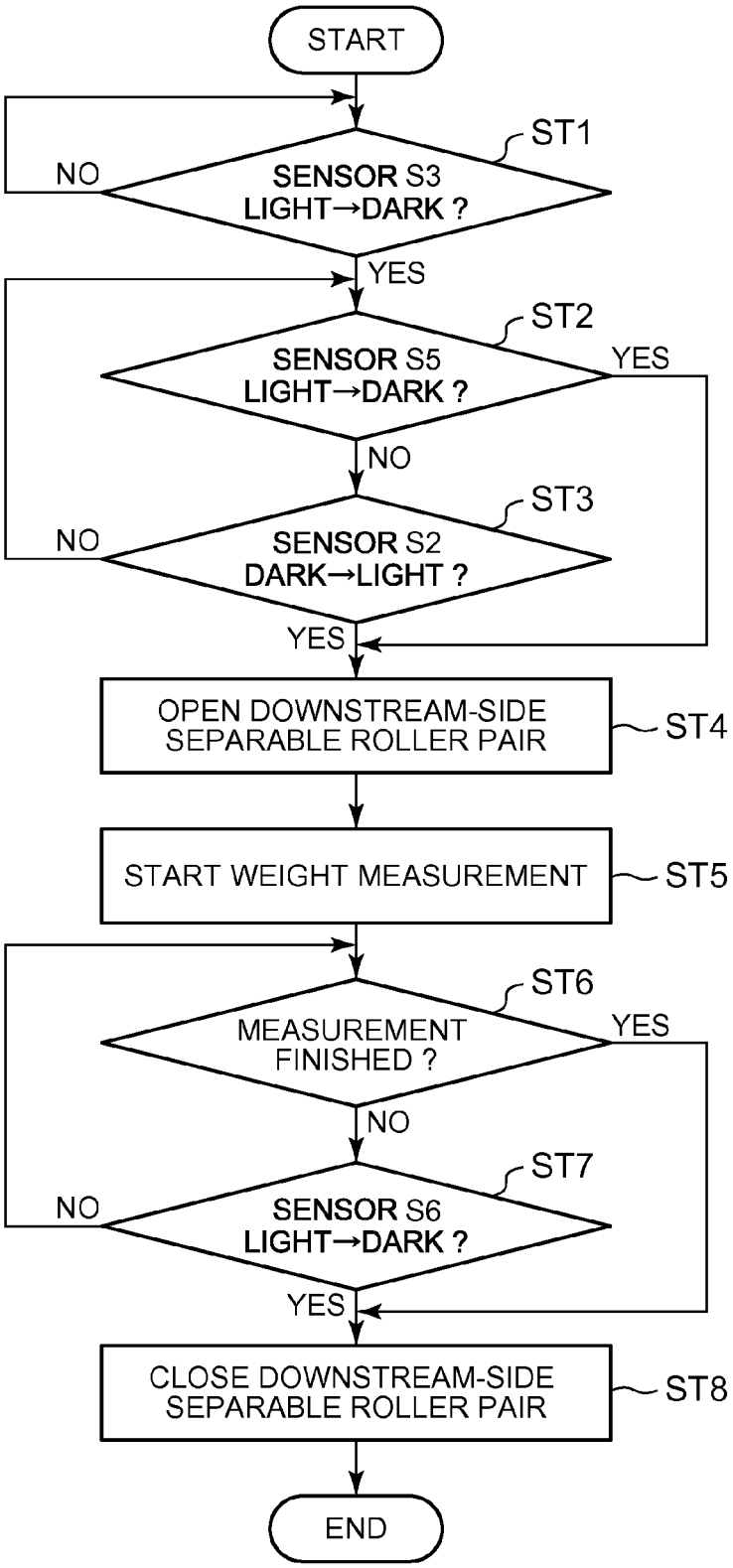
FIG. 10 is a flowchart illustrating the operation of the handling apparatus in FIG. 8 together with FIG. 9.

Referring to FIGS. 9 and 10, the following is an explanation of the operation of the handling apparatus 110 of the second embodiment. FIG. 9 is an operation diagram illustrating the operation of the handling apparatus 110, and FIG. 10 is a flowchart illustrating the operation of the handling apparatus 110.

In a standby state prior to the mail item M being fed into the handling apparatus 110, the controller 30 rotates the motors 11 and 14 so that the two holding roller pairs 3 and 5 of the weight measuring apparatus 10, the upstream-side conveying roller pair 8, the downstream-side separable roller pair 40 and the downstream-side conveying roller pair 6 are rotated at a certain speed. At this time, the downstream-side separable roller pair 40 may be open or closed. It should be noted that the controller 30 monitors the conveying position of the mail item M that is fed on the conveying path 2 to the handing apparatus 110 based on the output of the plurality of sensors S0 to S6.

Moreover, as a preparation before measuring the weight of the conveyed mail item M, the controller 30 measures the weight of the weight measuring apparatus 10 with the force sensor 7. That is to say, the controller 30 measures, in advance, the weight of the weight measuring apparatus 10 when no mail item M is being conveyed, and measures the weight of the mail item M by subtracting this from the weight of the weight measuring apparatus 10 when the mail item M is being conveyed.

When a plurality of mail items M is conveyed consecutively on the conveying path 2 and fed into the handling apparatus 110, then, based on the output of the sensor S3, the controller 30 first judges whether the mail item M to be processed is clamped by the nip of the holding roller pair 3 on the upstream side of the weight measuring apparatus 10 (FIG. 10, Step 1). For example, in the state in FIG. 9A, the leading edge in conveying direction of the mail item M has already passed the nip of the holding roller pair 3.

If it is judged in Step 1 that the leading edge in conveying direction of the mail item M is held by the holding roller pair 3 on the upstream side of the weight measuring apparatus 10 (Step 1: YES), then the controller 30 judges, based on the output of the sensor S2, whether the trailing edge in conveying direction of the mail item M has passed the nip of the upstream-side conveying roller pair 8 (Step 3). For example, if the mail item is a shortest mail item Mmin, then, immediately after it has been sensed in Step 1 that the leading edge in conveying direction of the shortest mail item Mmin is held by the holding roller pair 3, the trailing edge in conveying direction of the shortest mail item Mmin passes the optical axis of the sensor S2.

If it is judged in Step 3 that the trailing edge in conveying direction of the mail item M has passed the nip of the upstream-side conveying roller pair 8 (state in FIG. 9E) (Step 3: YES), then the controller 30 causes the motor 29 of the separating mechanism 20 to rotate, to space apart the driven roller 4R of the downstream-side separable roller pair 40 from the driving roller 4F and open the downstream-side separable roller pair 40 (Step 4).

Alternatively, if, as shown for example in FIG. 9D, the leading edge in conveying direction of the mail item M blocks the optical axis of the sensor S5 before it is sensed in Step 3 that the trailing edge in conveying direction of the mail item M has passed the optical axis of the sensor S2 (Step 3: NO; Step 2: YES), then the controller 30 opens the downstream-side separable roller pair 40 at that point in time (Step 4).

In the present embodiment, assuming that a plurality of mail items M are conveyed consecutively with a comparatively short gap, the downstream-side separable roller pair 40 is closed in a state in which the passage of the trailing edge in conveying direction of the mail item M is sensed in Step 3 with the sensor S2, or in a state in which the passage of the leading edge in conveying direction of the mail item M is sensed in Step 2 with the sensor S5, as shown in FIGS. 9A to 9C, but if the gap to the preceding conveyed mail item M is comparatively large, then it is also possible to open the downstream-side separable roller pair 40 at an earlier timing.

After opening the downstream-side separable roller pair 40 in Step 4, or, if the downstream-side separable roller pair 40 is already open, after the trailing edge in conveying direction of the mail item M has passed the nip of the upstream-side conveying roller pair 8 in Step 3, the controller 30 starts the weight measurement of the mail item M with the force sensor 7 of the weight measuring apparatus 10 (Step 5).

While the weight of the mail item M is measured, the mail item M is conveyed in a state in which, as shown for example in FIGS. 9E and 9F, no external force is imparted on it from any roller pairs other than the holding roller pairs 3 and 5 of the weight measuring apparatus 10. Thus, in the state of FIGS. 9E and 9F, there are no other roller pairs clamping the mail item M other than the two holding roller pairs 3 and 5 of the weight measuring apparatus 10, so that the weight of the mail item M can be measured with high precision.

After this, based on the output of the sensor S6, the controller 30 judges whether the front edge in conveying direction of the mail item M is clamped in the nip of the downstream-side conveying roller pair 6 (Step 7). Then, if it is judged in Step 7 that the front edge in conveying direction of the mail item M is clamped by the nip of the downstream-side conveying roller pair 6 (state in FIG. 9G) (Step 7: YES), or measuring the weight of the mail item M has finished before it has been sensed in Step 7 that the front edge in conveying direction of the mail item M has passed the optical axis of the sensor S6 (Step 7: NO; Step 6: YES), then the controller 30 rotates the motor 29 of the separating mechanism 20 such that the downstream-side separable roller pair 40 is closed (Step 8).

As described above, with the present embodiment, the controller 30 opens the downstream-side separable roller pair 40 as in Step 4 at the time when it is judged in Step 3 that the trailing edge in conveying direction of the mail item M has passed the nip of the upstream-side conveying roller pair 8, or before it is judged in Step 3 that the trailing edge in conveying direction of the mail item M has passed the nip of the upstream-side conveying roller pair 8, so that when the measurement of the weight of the mail item M is started in Step 5, the downstream-side separable roller pair 40 does not impart any conveying force on the mail item M and a precise weight measurement becomes possible.

In particular, if for example the longest mail item Mmax is processed, the downstream-side separable roller pair 40 is opened at the point in time when the controller 30 senses in Step 2 that the leading edge in conveying direction of this longest mail item Mmax has passed the nip of the downstream-side separable roller pair 40, before it is sensed in Step 3 that the trailing edge in conveying direction of this longest mail item Mmax has passed the nip of the upstream-side conveying roller pair 8 (state shown in FIG. 9D), so that the downstream-side separable roller pair 40 can be opened in advance at a timing slight before the weight measurement of the longest mail item Mmax starts (at the time of FIG. 9D), and the conveying state of the longest mail item Mmax can be stabilized before the weight measurement of the longest mail item Mmax starts.

That is to say, with the present embodiment, a shortest mail item Mmin can be reliably handed over from the holding roller pair 5 on the downstream side of the weight measuring apparatus 10 to the downstream-side separable roller pair 40 by closing the downstream-side separable roller pair 40, and if for example the weight of a longest mail item Mmax is to be measured, then a time for the weight measurement can be ensured that is longer than usual (that is, if there is no opening and closing of the downstream-side separable roller pair 40) by opening the downstream-side separable roller pair 40 at the above-described timing, and a sufficient processing time for the weight measurement can be ensured. Thus, a weight measurement with higher precision becomes possible.

Moreover, with the present embodiment, since it is sufficient to make the simple configurational change of enabling opening and closing of the roller pair (the downstream-side separable roller pair 40 in the present embodiment) that is next to the weight measuring apparatus 10 on the downstream side in conveying direction, the manufacturing costs of the apparatus can be kept low.

With the present embodiment, if the weight measurement of the mail item M is finished before the controller 30 has sensed in Step 7 that the leading edge in conveying direction of the mail item M has reached the nip of the downstream-side conveying roller pair 6, then the downstream-side separable roller pair 40 is closed, so that the mail items M can be reliably conveyed in a stable manner.

Furthermore, with the present embodiment, after the weight measurement of the postal item M has been finished, it becomes immediately possible to hand over the next mail item M to the holding roller pair 3 on the upstream side of the weight measuring apparatus 10, so that there is no necessity to widen the gap between the mail items M, and there is no necessity to branch the conveying path into two directions and to provide two weight measuring apparatuses 10 in parallel, so that the installation space of the apparatus does not become large.

Figure 11:
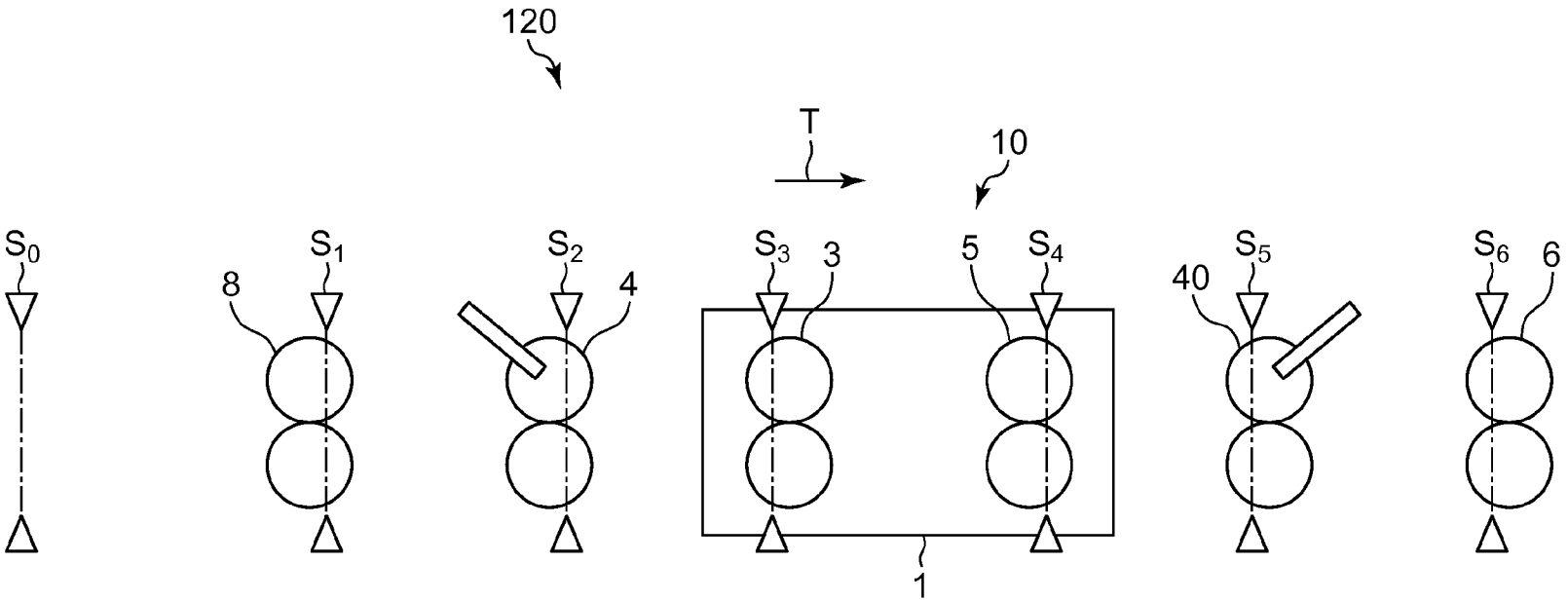
FIG. 11 is top view, viewed from above, of a mail handling apparatus according to a third embodiment.

FIG. 11 is a top view, taken from above, of a mail handling apparatus 120 according to a third embodiment (referred to below simply as "handling apparatus 120"). This handling apparatus 120 has a structure that combines the above-described handling apparatus 100 of the first embodiment and the handling apparatus 110 of the second embodiment. That is to say, a mail item M that is conveyed on the conveying path 2 in the arrow direction T in the drawing is passed along the upstream-side conveying roller pair 8, the upstream-side separable roller pair 4, the upstream-side holding roller pair 3 of the weight measuring apparatus 10, the downstream-side holding roller pair 5 of the weight measuring apparatus 10, the downstream-side separable roller pair 40, and the downstream-side conveying roller pair 6 in that order. It should be noted that the length in conveying direction from the nip of the upstream-side separable roller pair 4 to the nip of the downstream-side conveying roller pair 6 is shorter than four times the length in conveying direction of the shortest mail item (sheet) Mmin.

The upstream-side separable roller pair 4 can be opened and closed by a separating mechanism 20 (here, referred to as "upstream-side separating mechanism 20U"), whereas the downstream-side separable roller pair 40 can be opened and closed by a separating mechanism 20 (here, referred to as "downstream-side separating mechanism 20D"). Based on the output of the sensor S0, the controller 30 detects the length in conveying direction of the conveyed mail item M, and based on the output signal from the sensors S1 to S6, the controller 30 controls the upstream-side separating mechanism 20U and the downstream-side separating mechanism 20D, opening and closing the upstream-side separable roller pair 4 and the downstream-side separable roller pair 40. Here, the same reference numerals are assigned to structural elements having the same function as those in the handling apparatus 100 of the first embodiment or the handling apparatus 110 of the second embodiment described above, and their further explanation has been omitted.

Referring to FIGS. 12 to 17, the following is an explanation of several operation examples of the handling apparatus 120 of the present embodiment. First of all, as a first operation example, the case that a mail item M whose length in conveying direction is relatively short is conveyed and processed is explained with reference to FIGS. 12 and 13. As shown in FIG. 12A, when, after the front edge in conveying direction of the mail item M conveyed in arrow direction T on the conveying path 2 has passed the sensor S3 and the mail item M has been fed into the weight measuring apparatus 10, the trailing edge in conveying direction of the mail item M passes the sensor S2 (state shown in FIG. 12B), the weight measurement of the mail item M with the weight measuring apparatus 10 becomes possible. At this time, since the length of the mail item M measured in advance by the sensor S0 is relatively short, the upstream-side separable roller pair 4 stays closed. That is to say, in this case, the upstream-side separable roller pair 4 functions in the same manner as the other conveying roller pairs.

After this, the mail item M is conveyed further and passes the weight measuring apparatus 10, and until the leading edge in conveying direction of the mail item M is detected by the sensor S5 (state shown in FIG. 12D), the weight of the mail item M is measured. In this situation, the length in conveying direction of the mail item M is relatively short, so that the weight measurement of the mail item M is finished before the leading edge in conveying direction of the mail item reaches the sensor S5.

Figure 12A:
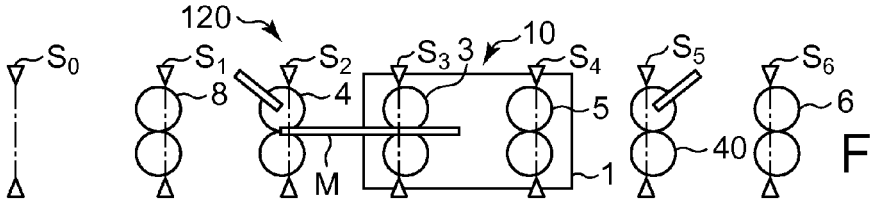
FIGS. 12A to 12F are operation diagrams illustrating a first operation example of the handling apparatus in FIG. 11.
Figure 12B:
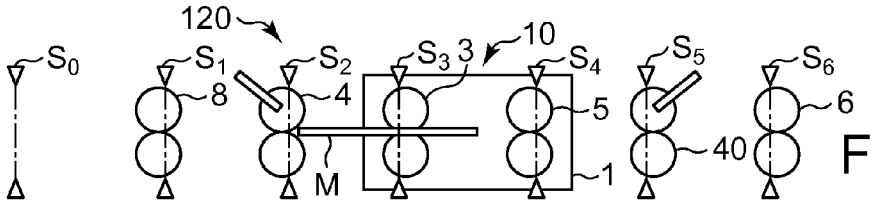
Figure 12C:
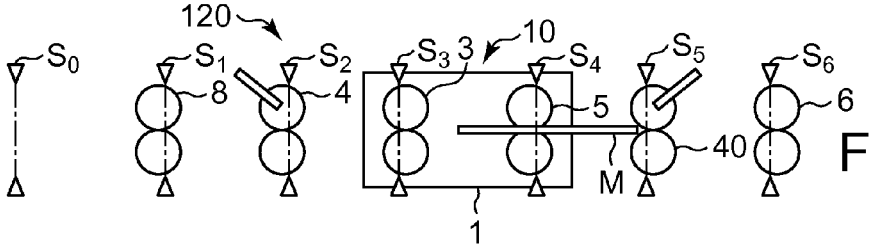
Figure 12D:
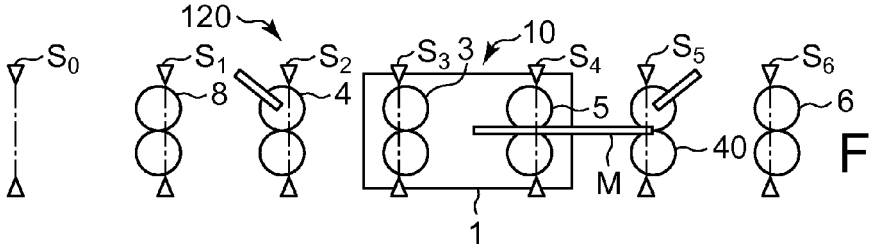
Figure 12E:
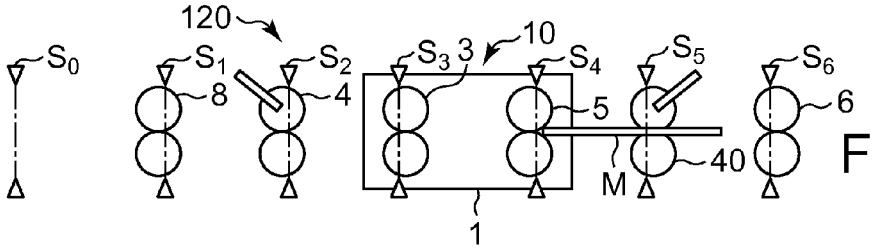
Figure 12F:
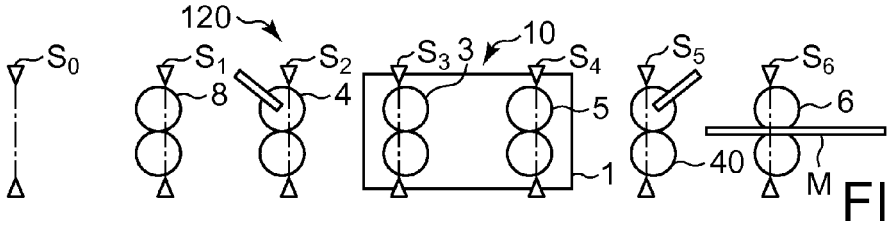

For this reason, when the leading edge in conveying direction of the mail item M reaches the sensor S5, the downstream-side separable roller pair 40 stays closed (state shown in FIG. 12D). In other words, before the leading edge in conveying direction of the mail item M reaches the sensor S5, the downstream-side separable roller pair 40 is not opened. That is to say, also here, the downstream-side separable roller pair 40 functions in a similar manner as the other conveying roller pairs.

Figure 13A:
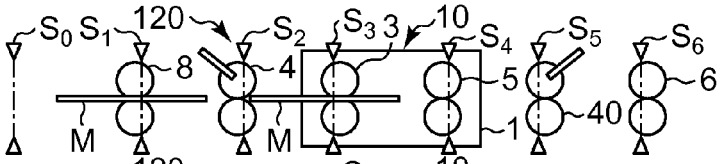
FIGS. 13A to 13J are operation diagrams illustrating a first operation example of the handling apparatus in FIG. 11.
Figure 13B:
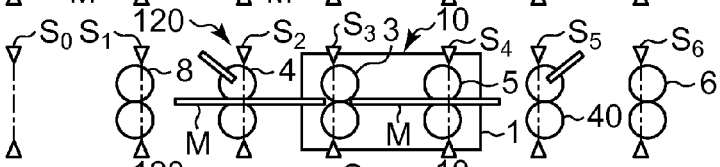
Figure 13C:
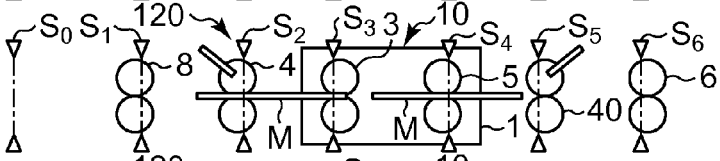
Figure 13D:
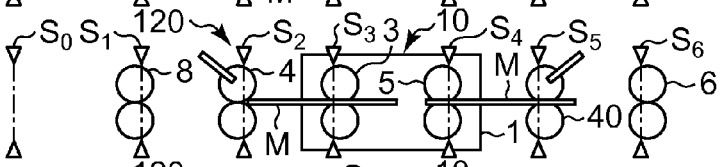
Figure 13E:
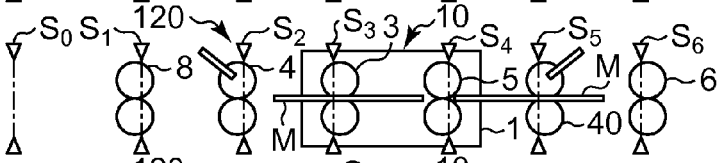

On the other hand, if two comparatively short mail items are conveyed consecutively as shown in FIG. 13, after the trailing edge in conveying direction of the preceding mail item M has passed the sensor S2, as shown in FIG. 13A, the measurement of the weight of this preceding mail item M begins. The weight measurement of the preceding mail item M continues until the leading edge in conveying direction of the preceding mail item M reaches the sensor S5 (state shown in FIG. 13D) or until the leading edge in conveying direction of the following mail item M reaches the sensor S3 (state shown in FIG. 13C).

Figure 13F:
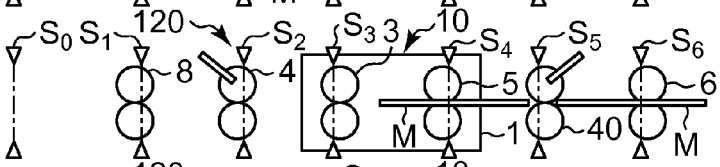
Figure 13G:
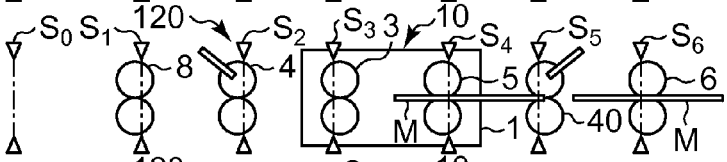
Figure 13H:
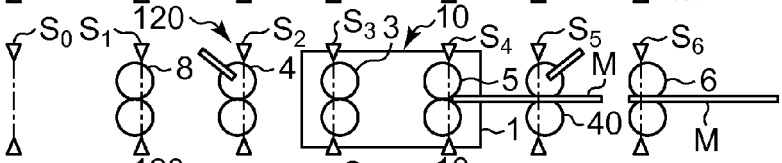
Figure 13I:
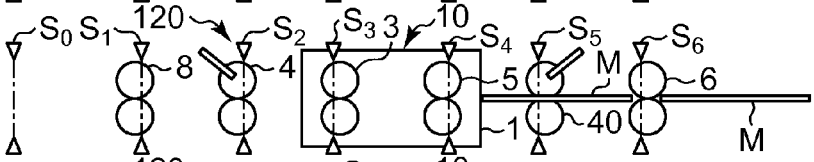
Figure 13J:
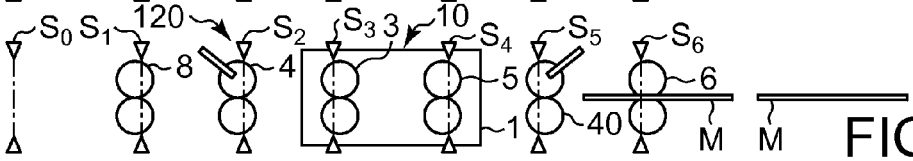

Moreover, the measurement of the weight of the following mail item M is carried out in the time after the trailing edge in conveying direction of the preceding mail item M has passed the sensor S4 (state shown in FIG. 13E) and before the leading edge in conveying direction of the mail item M (the following mail item M) has reached the sensor S5 (state shown in FIG. 13F). That is to say, also in this case, it is detected by the sensor S0 in advance that the lengths in conveying direction of the two mail items M that are conveyed consecutively are comparatively short, so that the upstream-side separable roller pair 4 and the downstream-side separable roller pair 40 are not opened.

That is to say, if relatively short mail items M are conveyed and processed as in this first operation example, then the upstream-side separable roller pair 4 and the downstream-side separable roller pair 40 are not opened, and function similarly to the other conveying roller pairs.

As a second operation example, the following is an explanation with reference to FIGS. 14 and 15 of the case that a mail item M whose length in conveying direction is relatively long is conveyed and processed. When, after the leading edge in conveying direction of the mail item M conveyed in the arrow direction T on the conveying path 2 has passed the sensor S3 and the mail item M has been fed into the weight measuring apparatus 10, as shown in FIG. 14A, the trailing edge in conveying direction of the mail item M passes the sensor 51 as shown in FIG. 14B, the measurement of the weight of the mail item M with the weight measuring apparatus 10 becomes possible. At this time, the length of the mail item M measured in advance by the sensor S0 is relatively long, so that the upstream-side separable roller pair 4 is opened in advance before the weight measurement of the mail item M is started.

Figure 14A:
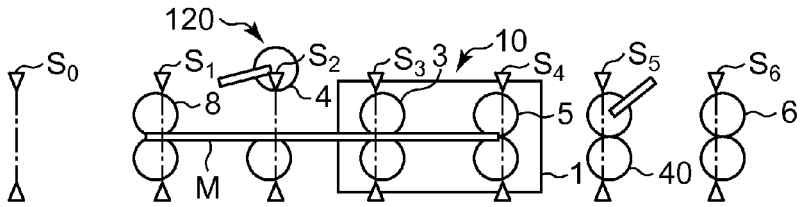
FIGS. 14A to 14F are operation diagrams illustrating a second operation example of the handling apparatus in FIG. 11.
Figure 14B:
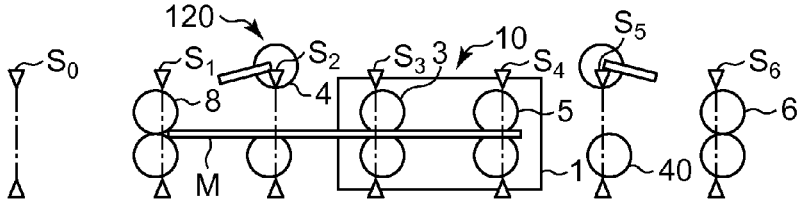
Figure 14C:
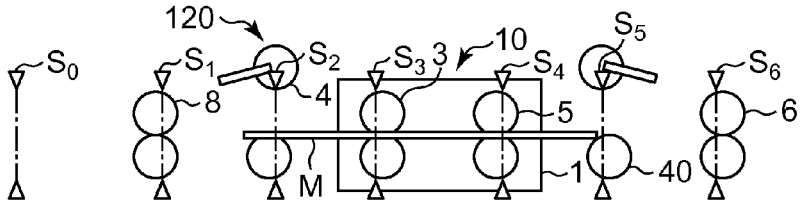
Figure 14D:
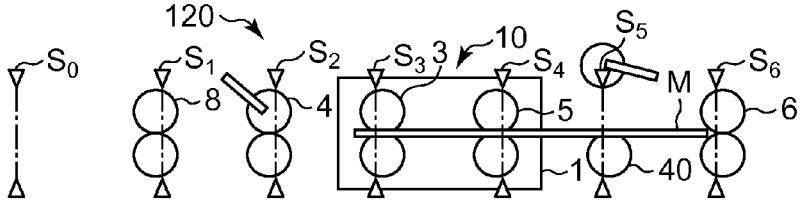
Figure 14E:
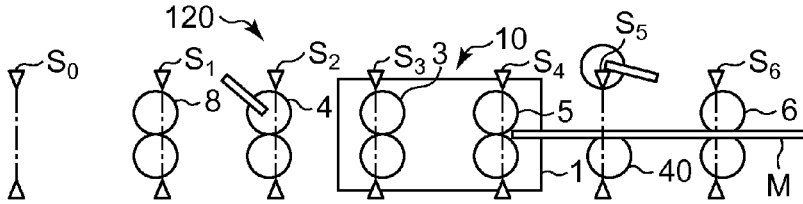
Figure 14F:
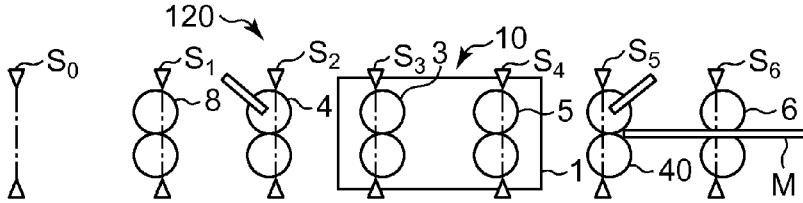

After this, the mail item M is conveyed further and passes through the weight measuring apparatus 10, and the weight of the mail item M is measured until the leading edge in conveying direction of the mail item M is detected by the sensor S6 (state shown in FIG. 14D). In this situation, the fact that the length in conveying direction of the mail item M is relatively long has already been detected by the sensor S0, so that the downstream-side separable roller pair 40 is opened in advance, before the front edge in conveying direction of the mail item M passes the sensor S5.

That is to say, the upstream-side separable roller pair 4 and the downstream-side separable roller pair 40 are opened at a suitable timing, such that no undesired force is applied by the upstream-side separable roller pair 4 or the downstream-side separable roller pair 40 to the mail item M while the weight of the mail item M is being measured. Moreover, after the trailing edge in conveying direction of the mail item M has passed the upstream-side separable roller pair 4, the upstream-side separable roller pair 4 is closed for the following mail item M (state shown in FIG. 14D). Furthermore, after the trailing end in conveying direction of the mail item M has passed the downstream-side separable roller pair 40, the downstream-side separable roller pair 40 is closed (state shown in FIG. 14F).

Figure 15A:
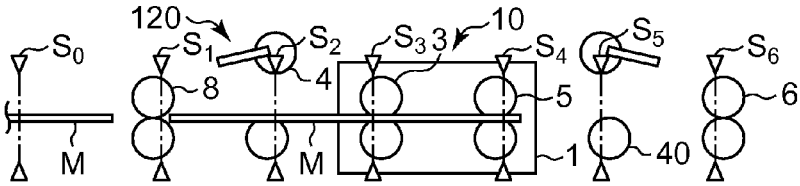
FIGS. 15A to 15H are operation diagrams illustrating a second operation example of the handling apparatus in FIG. 11.
Figure 15B:
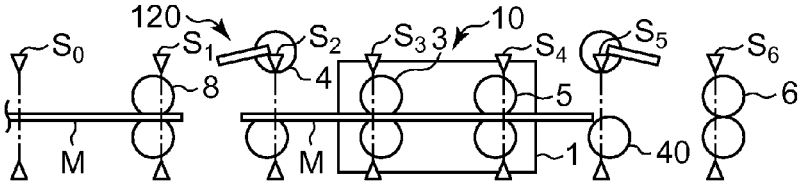
Figure 15C:
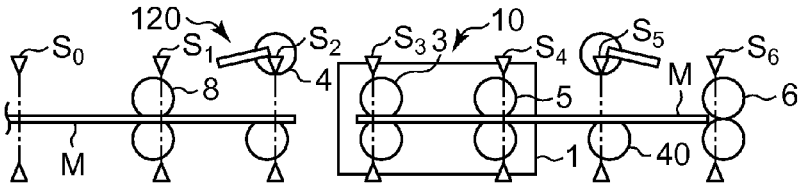
Figure 15D:
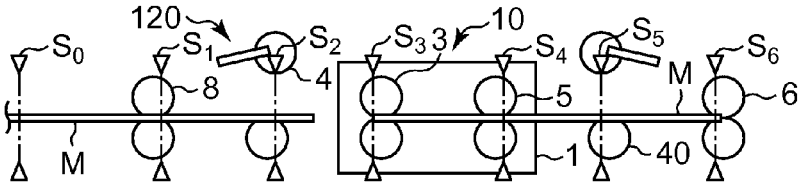

On the other hand, if two relatively long mail items M are conveyed consecutively, as shown in FIG. 15, then, after the rear end in conveying direction of the preceding mail item M has passed the sensor S1 as shown in FIG. 15A, the measurement of the length of the preceding mail item M starts. The measurement of the length of the preceding mail item M continues until the leading edge in conveying direction of the preceding mail item M reaches the sensor S6 (the state shown in FIG. 15D), or until the leading edge in conveying direction of the following mail item M reaches the sensor S3.

Figure 15E:
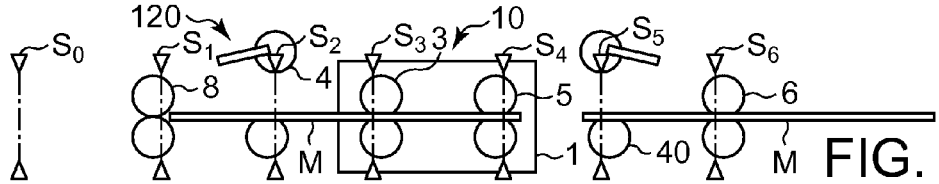
Figure 15F:
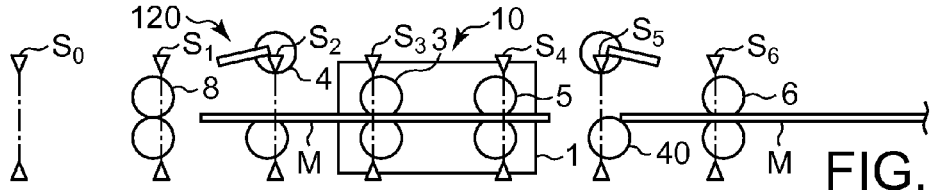
Figure 15G:
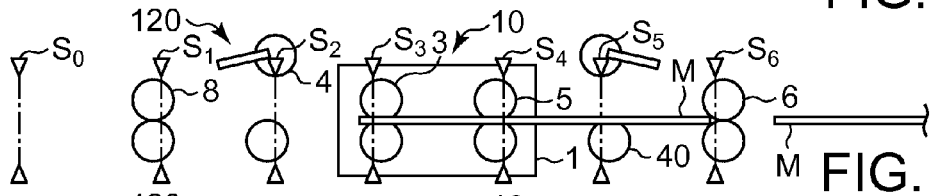
Figure 15H:
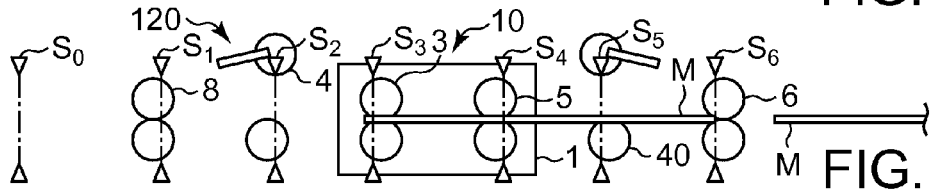

Moreover, the measurement of the weight of the following mail item M is started after the trailing edge in conveying direction of the preceding mail item has passed the sensor S4, and after the trailing edge in conveying direction of the mail item M (the following mail item M) has passed the sensor S1 (state shown in FIG. 15E). Then, after this, the measurement of the length of the following mail item M is finished in the time until the leading edge in conveying direction of the mail item M has reached the sensor S6 (state shown in FIG. 15G).

In this case, the controller 30 has detected in advance that the lengths in conveying direction of the two mail items M that are conveyed consecutively are relatively long, so that the upstream-side separable roller pair 4 and the downstream-side separable roller pair 40 are not closed.

Figure 16A:
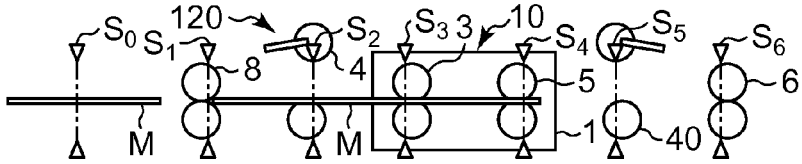
FIGS. 16A to 16I are operation diagrams illustrating a third operation example of the handling apparatus in FIG. 11.
Figure 16B:
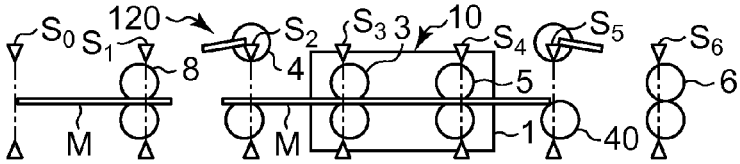

Next, as a third operation example, the case is explained with reference to FIG. 16 that a mail item M whose length in conveying direction is relatively short is conveyed consecutively to a mail item M whose length in conveying direction is relatively long. As shown in FIG. 16A, when a relatively long preceding mail item M is fed into the weight measuring apparatus 10 and its rear end passes the sensor S1, then the weight measurement of the mail item M becomes possible. In this situation, the fact that the length of the mail item M in conveying direction is relatively long has already been detected by the sensor S0, so that at the time when the weight measurement of the mail item M starts (state shown in FIG. 16A), the upstream-side separable roller pair 4 and the downstream-side separable roller pair 40 are opened.

The weight measurement of the mail item M is carried out in the time until the leading edge in conveying direction of the mail item M (the relatively long preceding mail item M) has reached the sensor S6 (state shown in FIG. 16D), or until the following mail item M has been fed into the nip of the holding roller pair 3 on the upstream side of the weight measuring apparatus 10.

Figure 16C:
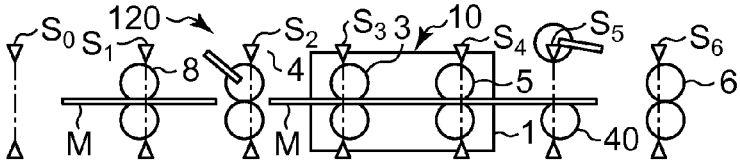
Figure 16D:
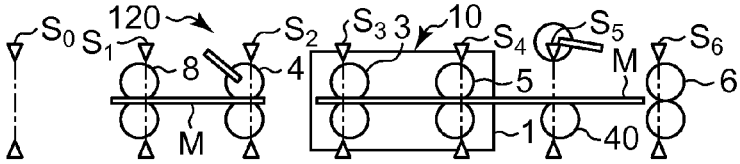
Figure 16E:
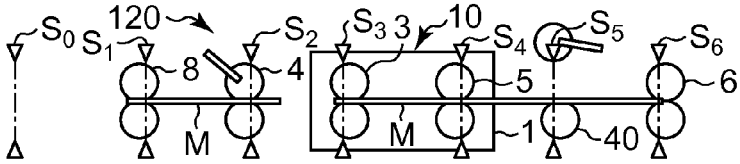

Moreover, in this third operation example, it is detected in advance with the sensor S0 that the length of the following mail item M in conveying direction is relatively short, so that after the trailing edge in conveying direction of the preceding mail item M has passed the sensor S2, the upstream-side separable roller pair 4 is closed as shown in FIG. 16C, in order to securely hand over and convey the following mail item M to the weight measuring apparatus 10.

Figure 16F:
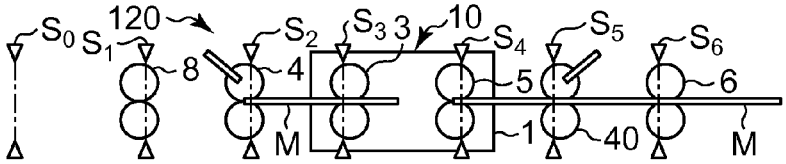
Figure 16G:
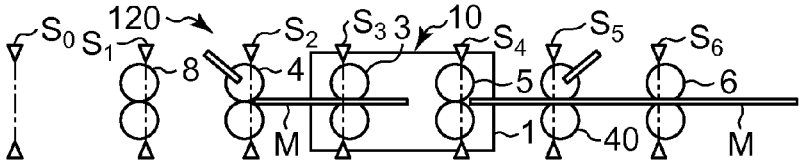
Figure 16H:
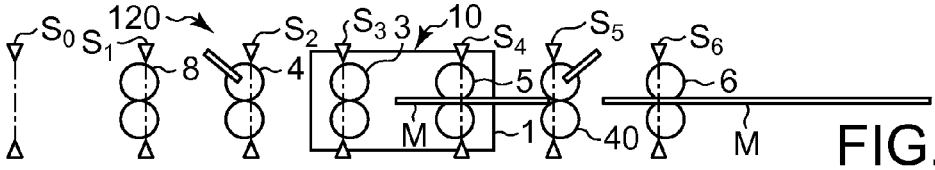
Figure 16I:
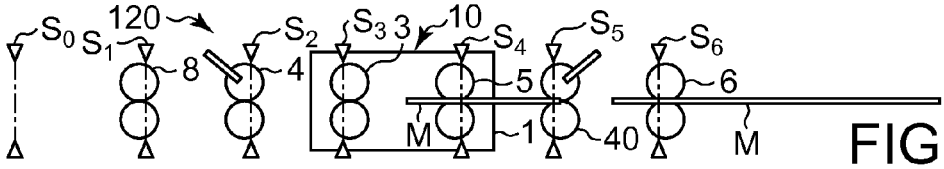

Then, the weight measurement of the relatively short following mail item M is started when the leading edge in conveying direction of the mail item M (the following mail item M) has been fed into the weight measuring apparatus 10, and after the trailing edge in conveying direction of the preceding mail item M has passed the sensor S4 (state shown in FIG. 16G). Moreover, the weight measurement of the following mail item M is finished until the leading edge in conveying direction of the mail item M (the following mail item M) reaches the sensor S5 (state shown in FIG. 16H).

Needless to say, at the time when the weight measurement of the following mail item M starts, the weight measurement of the preceding mail item M has finished, so that the downstream-side separable roller pair 40 is closed. In other words, at the time when the following mail item M is held by the upstream-side holding roller pair 3 of the weight measuring apparatus 10 (state shown in FIG. 16F), the weight measurement of the preceding mail item M becomes impossible, so that at this time, the downstream-side separable roller pair 40 is closed.

That is to say, since it has already been detected with the sensor S0 that the following mail item M is a comparatively short mail item, the downstream-side separable roller pair 40 is closed after the trailing edge in conveying direction of the preceding mail item M has passed the sensor S5 (state shown in FIG. 16H), the trailing edge in conveying direction of the preceding mail item has passed the sensor S4 (state shown in FIG. 16G), or after the following mail item M has been fed into the weight measuring apparatus 10 (state shown in FIG. 16F).

Figure 17A:
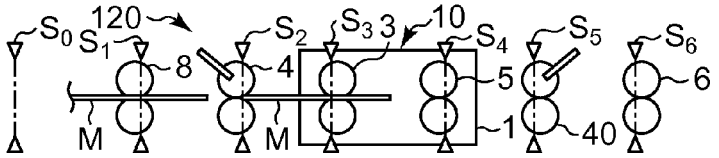
FIGS. 17A to 17I are operation diagrams illustrating a fourth operation example of the handling apparatus in FIG. 11.

As a fourth operation example, the case is explained with reference to FIG. 17 that a mail item M whose length in conveying direction is relatively long is conveyed consecutively to a mail item M whose length in conveying direction is relatively short. As shown in FIG. 17A, when a relatively short preceding mail item M is fed into the weight measuring apparatus 10 and its rear end passes the sensor S2, then the weight measurement of this mail item M becomes possible. In this situation, the fact that the length of the mail item M in conveying direction is relatively short has already been detected by the sensor S0, so that at the time when the weight measurement of the mail item M starts (state shown in FIG. 17A), the upstream-side separable roller pair 4 and the downstream-side separable roller pair 40 are closed.

Figure 17B:
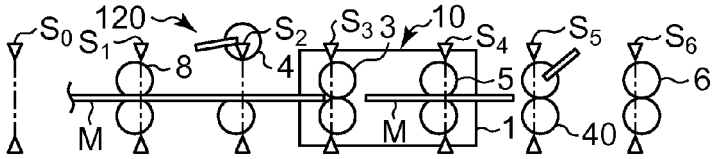
Figure 17C:
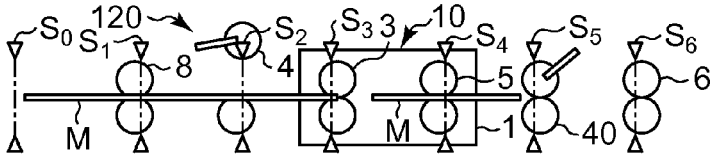

The weight measurement of the mail item M is carried out in the time until the leading edge in conveying direction of the mail item M (the relatively short preceding mail item M) has reached the sensor S5 (state shown in FIG. 17D), or until the following mail item M has been fed into the nip of the holding roller pair 3 on the upstream side of the weight measuring apparatus 10 (state shown in FIG. 17C).

Moreover, in this fourth operation example, it is detected in advance with the sensor S0 that the length of the following mail item M in conveying direction is relatively long, so that after the trailing edge in conveying direction of the preceding mail item M has passed the sensor S2, the upstream-side separable roller pair 4 is opened as shown in FIG. 17B.

Figure 17D:
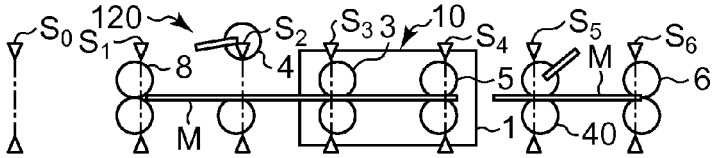
Figure 17E:
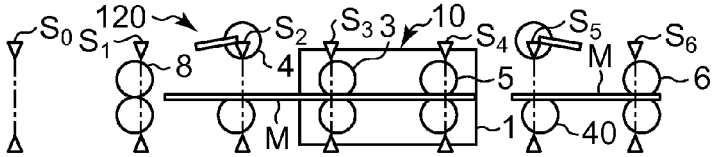
Figure 17F:
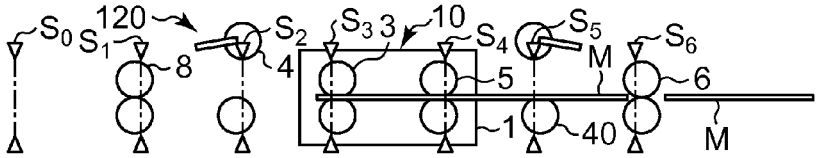
Figure 17G:
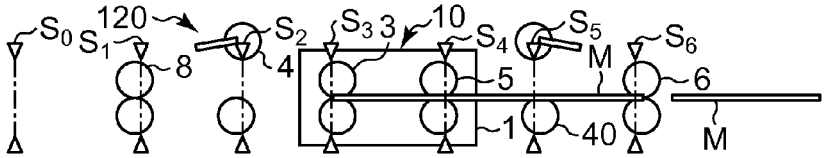
Figure 17H:
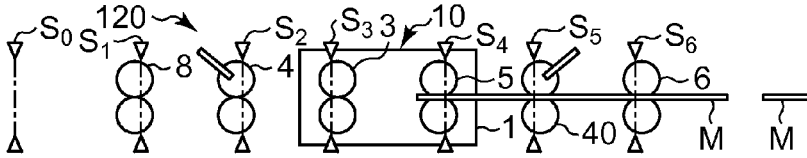
Figure 17I:
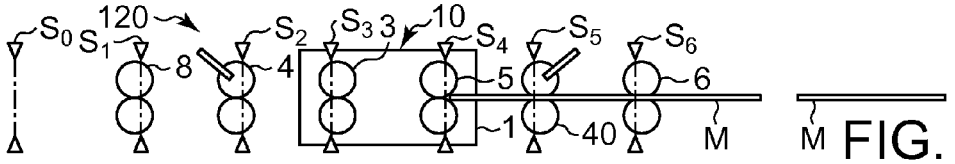

Then, the weight measurement of the relatively long following mail item M is started when the leading edge in conveying direction of the mail item M (the following mail item M) has been fed into the weight measuring apparatus 10, after the trailing edge in conveying direction of the preceding mail item M has passed the sensor S4, and after the trailing edge in conveying direction of the following mail item M has passed the sensor S1 (state shown in FIG. 17D). Moreover, the weight measurement of the following mail item M is finished until the leading edge in conveying direction of the mail item M (the following mail item M) reaches the sensor S6 (state shown in FIG. 17G).

Since it has been detected in advance with the sensor S0 that the length of the following mail item M in conveying direction is relatively long, the downstream-side separable roller pair 40 is opened after the relatively short preceding mail item M has been handed over to the nip of the downstream-side conveying roller pair 6, in order to gain time for measuring the weight of the following mail item M.

With the present embodiment as described above, similar effects can be achieved as with the above-described first and second embodiments.

Figure 18:
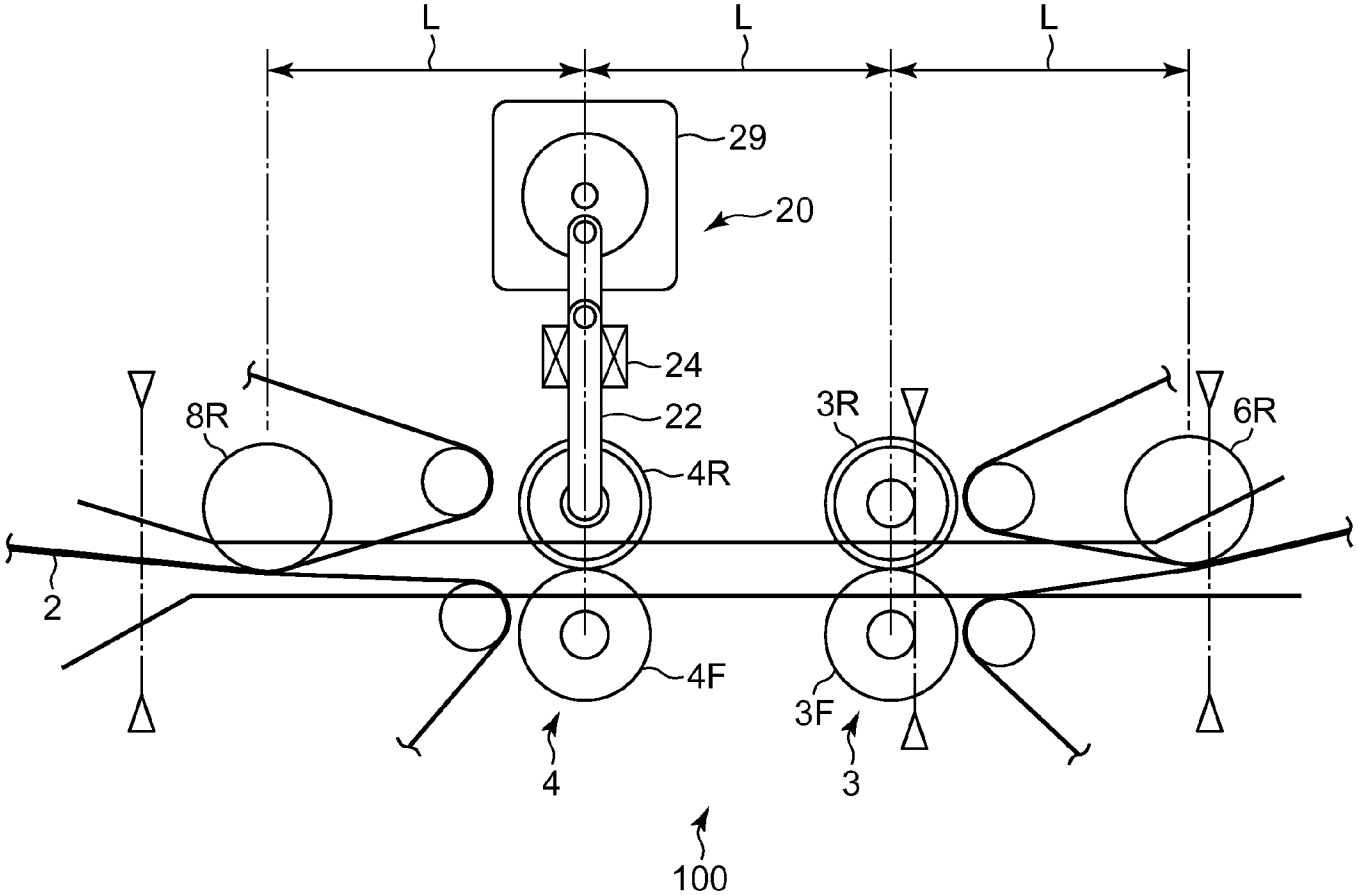
FIG. 18 is a top view showing a simplified apparatus configuration of the handling apparatus in FIG. 3.
Figure 19:
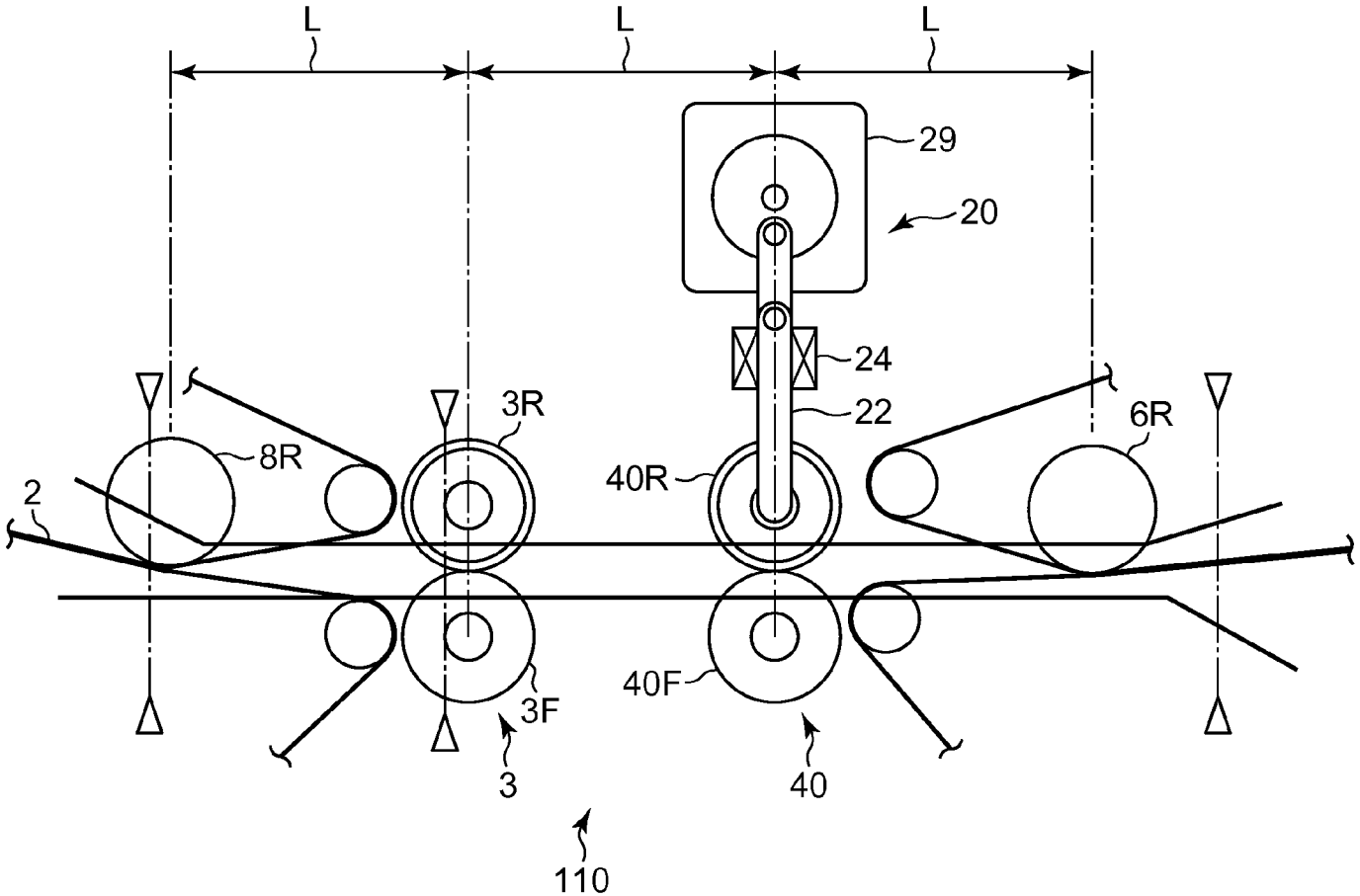
FIG. 19 is a top view showing a simplified apparatus configuration of the handling apparatus in FIG. 9.

Referring to FIGS. 18 and 19, the following is a discussion of the relation between the distance between the plurality of rollers lined up along the conveying path 2 and the above-described length in conveying direction of the shortest mail item Mmin and the longest mail item Mmax.

It should be noted that here, in order to keep the explanations simple, a simplified apparatus configuration is shown, in which the weight measuring apparatus 10 is assumed to have only one holding roller pair (holding roller pair 3). That is to say, FIG. 18 shows a simplified apparatus configuration of the handling apparatus 100 of the above-described first embodiment, and FIG. 19 shows a simplified apparatus configuration of the handling apparatus 110 of the above-described second embodiment.

In the handling apparatuses 100 and 110, a configuration is adopted, in which, instead of the upstream-side conveying roller pair 8, two belts are wound around the conveying roller 8R, and instead of the downstream-side conveying roller pair 6, two belts are wound around the conveying roller 6R. In this case, the location where the two belts are wound around the conveying roller 8R (6R) functions as a conveying nip that can impart a conveying force on the mail items M.

As explained for the above-described embodiments, the distance L between the nips of neighboring roller pairs along the conveying path 2, that is to say, the upstream-side conveying roller pair 8, the upstream-side separable roller pair 4, the holding roller pair 3 of the weight measuring apparatus 10, the downstream-side separable roller pair 40, and the downstream-side conveying roller pair 6 is set shorter than the length in conveying direction of the shortest mail item Mmin. Thus, it is possible to securely hand over and convey mail items M of all different lengths between the roller pairs.

That is to say, in the handling apparatus 100 of FIG. 18, the distance between the nip of the conveying roller 8R on the upstream side and the nip of the upstream-side separable roller pair 4, the distance between the nip of the upstream-side separable roller pair 4 and the nip of the holding roller pair 3, and the distance between the nip of the holding roller pair 3 and the nip of the conveying roller 6R on the downstream side are each set to be shorter than the length of the shortest mail item Mmin in conveying direction. In other words the length in conveying direction from the nip of the upstream-side separable roller pair 4 to the nip of the conveying roller 6R on the downstream side is shorter than twice the length of the shortest mail item Mmin in conveying direction.

Moreover, also in the handling apparatus 110 in FIG. 19, the distance between the nip of the conveying roller 8R on the upstream side and the nip of the holding roller pair 3, the distance between the nip of the holding roller pair 3 and the nip of the downstream-side separable roller pair 40, and the distance between the nip of the downstream-side separable roller pair 40 and the nip of the conveying roller 6R on the downstream side are each set to be shorter than the length of the shortest mail item Mmin in conveying direction. In other words the length in conveying direction from the nip of the conveying roller 8R on the upstream side to the nip of the downstream-side separable roller pair 40 is shorter than twice the length of the shortest mail item Mmin in conveying direction.

On the other hand, in order to measure the weight of a longest mail item Mmax, it is necessary to make the distance between the nip of the conveying roller 8R on the upstream side and the nip of the conveying roller 6R on the downstream side longer than the length of the longest mail item Mmax in conveying direction.

That is to say, in the handling apparatus 100 shown in FIG. 18, in the time after the leading edge in conveying direction of the longest mail item Mmax that is conveyed on the conveying path 2 is held by the holding roller pair 3 and the trailing edge in conveying direction of the mail item Mmax has passed the nip of the conveying roller 8R on the upstream side, and until the leading edge in conveying direction of the mail item M passes the nip of the conveying roller 6R on the downstream side, it becomes possible to measure the weight of that longest mail item Mmax in a state in which the upstream-side separable roller pair 4 is open, but if the distance between the nip of the conveying roller 8R on the upstream side and the nip of the conveying roller 6R on the downstream side is not at least longer than the length of the longest mail item Mmax in conveying direction, then it is not possible to ensure the time for measuring the weight of this longest mail item Mmax.

Similarly, in the handling apparatus 110 shown in FIG. 19, in the time after the leading edge in conveying direction of the longest mail item Mmax that is conveyed on the conveying path 2 is held by the holding roller pair 3 and the trailing edge in conveying direction of the mail item Mmax has passed the nip of the conveying roller 8R on the upstream side, and until the leading edge in conveying direction of the mail item Mmax passes the nip of the conveying roller 6R on the downstream side, it becomes possible to measure the weight of that longest mail item Mmax in a state in which the downstream-side separable roller pair 40 is open, but if the distance between the nip of the conveying roller 8R on the upstream side and the nip of the conveying roller 6R on the downstream side is not at least longer than the length of the longest mail item Mmax in conveying direction, then it is not possible to ensure the time for measuring the weight of this longest mail item Mmax.

Figure 20:
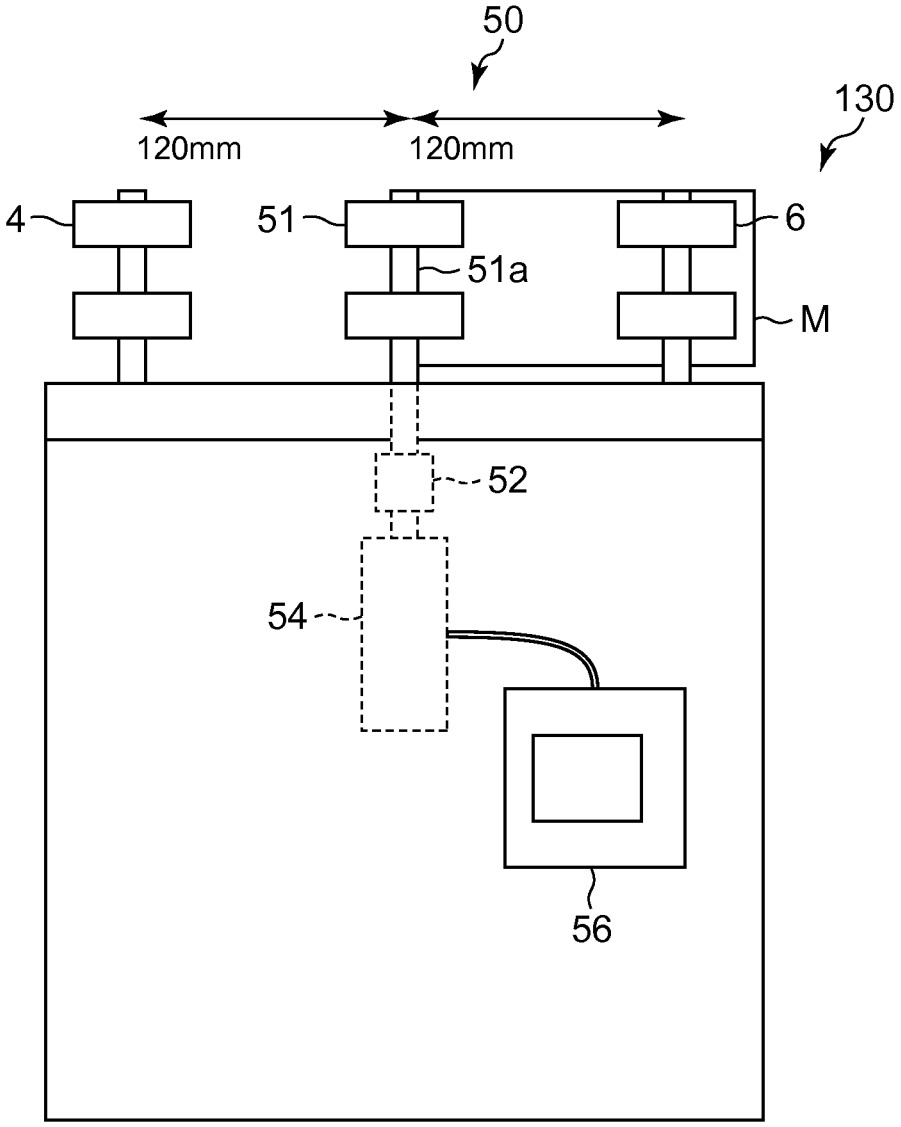
FIG. 20 is a diagrammatic view, viewed from the front, showing a mail handling apparatus according to a fourth embodiment.

Referring to FIG. 20, the following is an explanation of a mail handling apparatus 130 according to a fourth embodiment (referred to below simply as "handling apparatus 130"). Other than having a gap correction apparatus 50 (processing portion) instead of the weight measuring apparatus 10, the handling apparatus 130 of this embodiment has a structure that is substantially the same as the handling apparatus 100 of the first embodiment described above. Thus, structural elements having the same function as those in the above-described first embodiment are assigned the same reference numerals and their further explanation has been omitted.

That is to say, in the handling apparatus 130 of the present embodiment, the mail item M that is conveyed on the conveying path 2 is passed along the upstream-side separable roller pair 4, the holding roller pair 51 of the gap correction apparatus 50, and the downstream-side conveying roller pair 6 in that order. The gap correction apparatus 50 is provided mechanically independent from the upstream-side and the downstream-side conveying system of the handling apparatus 130. Therefore, the gaps before and after the mail item M passing through the gap correction apparatus 50 can be corrected with high precision.

The gap correction apparatus 50 includes a holding roller pair 51 that conveys the mail item M while clamping it, by taking in with a nip the mail item M conveyed on the conveying path 2 and rotating it. The holding roller pair 51 includes a holding roller 51F and a holding roller 51R. The holding roller 51F is arranged on the front side of the apparatus and the holding roller 51R is arranged on the rear side of the apparatus, with the conveying path 2 arranged between them. The holding roller pair 51 of the gap correction apparatus 50 has substantially the same structure as the holding roller pair 3 of the weight measuring apparatus 10. Thus, a detailed explanation of the holding roller pair 51 is omitted.

A motor 54 is connected via a coupling 52 to the rotation shaft 51*a* of the holding roller 51F on the front side, and this front-side holding roller 51F functions as a driving roller. Furthermore, a control board 56 is connected to this motor 54, enabling rotation speed control of the motor 54.

Moreover, also in the handling apparatus 130 of the present embodiment, the distance between the nips of the plurality of roller pairs lined up along the conveying path 2 is set to a constant length. That is to say, the distance between the nip of the upstream-side separable roller pair 4 and the nip of the holding roller pair 51 of the gap correction apparatus 50 as well as the distance between the nip of the holding roller pair 51 of the gap correction apparatus 50 and the nip of the downstream-side conveying roller pair 6 is set to a distance that is shorter (120 mm in the present embodiment) than the length of the shortest mail item Mmin in conveying direction. That is to say, the length in conveying direction from the nip of the upstream-side separable roller pair 4 to the nip of the downstream-side conveying roller pair 6 is set to be shorter than twice the length of the shortest mail item (sheet) Mmin in conveying direction.

Referring to FIG. 21, the following is an explanation of the operation of the handling apparatus 130 with the above-described structure. In the standby state before a mail item M is fed into the handling apparatus 130, the controller 30 closes the upstream-side separable roller pair 4 (state shown in FIG. 21A). Then, every time mail items M are conveyed on the conveying path 2, the controller 30 detects the length of each mail item M in conveying direction and the spacing (gap) between the mail items M, with the sensor S0 that is arranged upstream in conveying direction from the upstream-side conveying roller pair 8.

To detect the length of a mail item M, the controller 30 calculates the length of the mail item M based on the conveying speed of the mail item M and the time after the leading edge in conveying direction of the mail item M has passed the sensor S0 and the output from the sensor S0 has gone from light to dark, until the trailing edge in conveying direction of the mail item M has passed the sensor S0 and the output from the sensor S0 has gone from dark to light. Moreover, to detect a gap between mail items M, the controller 30 calculates the gap between mail items M based on the conveying speed of the mail items M and the time after the trailing edge in conveying direction of a preceding mail item M has passed the optical axis of the sensor S0 until the leading edge in conveying direction of the following mail item M passes the sensor S0.

Figure 21A:
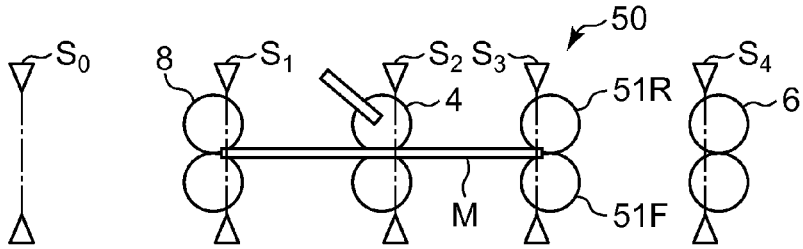
FIGS. 21A to 21E are operation diagrams illustrating the operation of the handling apparatus in FIG. 20.
Figure 21B:
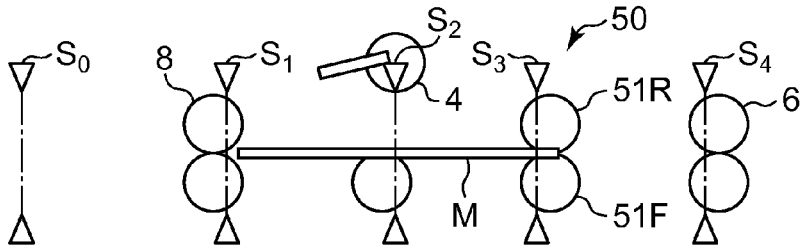
Figure 21C:
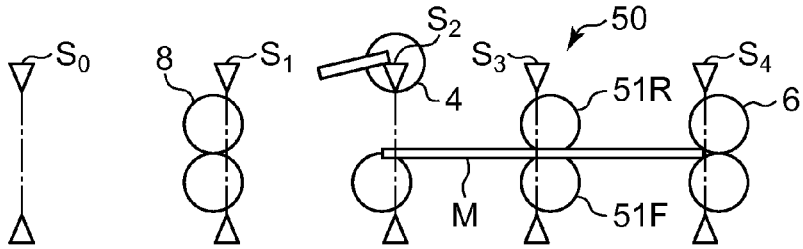
Figure 21D:
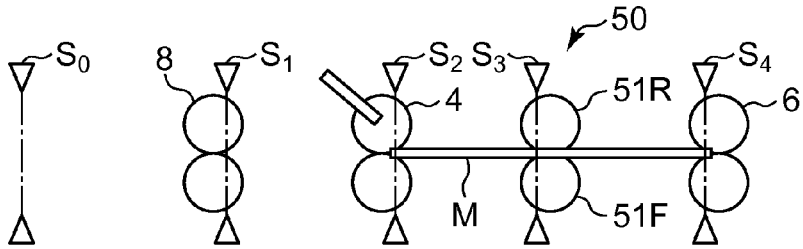
Figure 21E:
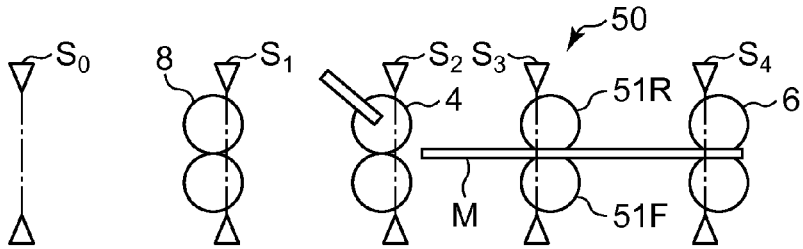

Then, when the leading edge in conveying direction of the conveyed mail item M reaches the nip of the holding roller pair 51 of the gap correction apparatus 50 and the optical axis of the sensor S3 is blocked (state shown in FIG. 21A), the controller 30 opens the upstream-side separable roller pair 4 to undertake a gap correction of the mail items M (state shown in FIG. 21B). Furthermore, at this time, the controller 30 monitors the output of the sensor S1, and taking the fact that the trailing edge in conveying direction of the mail item M has passed the nip of the upstream-side conveying roller pair 8 (state shown in FIG. 21B) as a trigger, the controller 30 starts the rotation control of the motor 54 of the holding roller 51F of the gap correction apparatus 50, so as to change the conveying speed of the mail item M.

The gap between the mail items M can be controlled by decelerating or accelerating the conveying speed of the mail items M. In the present embodiment, since the length of all conveyed mail items M in conveying direction as well as the length of the gaps has been detected in advance with the sensor S0, the gaps between the mail items M can be controlled to the desired value by accelerating or decelerating the motor 54 based on the length of the mail items M in conveying direction and the gap length.

After this, the controller 30 monitors the output of the sensor S4 and closes the upstream-side separable roller pair 4, taking the fact that the leading edge in conveying direction of the mail item M has reached the nip of the downstream-side conveying roller pair 6 (state shown in FIG. 21D) or the fact that the gap correction control of the mail items M has finished as a trigger.

With the handling apparatus 130 of the present embodiment as described above, similar effects can be achieved as with the handling apparatus 100 of the above-described first embodiment. That is to say, the upstream-side separable roller pair 4 is opened at the point in time when the trailing edge in conveying direction of the mail item M fed into the gap correction apparatus 50 has passed the nip of the upstream-side conveying roller pair 8, so that the gap correction of the mail items M can be started before the trailing edge in conveying direction of the mail item M passes the nip of the upstream-side separable roller pair 4, the gap correction can be started at an earlier timing, and a more precise gap correction becomes possible.

Moreover, with the present embodiment, since it is sufficient to make the simple configurational change of enabling opening and closing of the roller pair (the upstream-side separable roller pair 4 in the present embodiment) that is next to the gap correction apparatus 50 on the upstream side in conveying direction, a large-scale redesign of the apparatus is unnecessary, so that also the manufacturing costs of the apparatus can be kept low.

Moreover, with the present embodiment, if the gap correction of the mail items M is finished before sensing that the leading edge in conveying direction of the mail item M has reached the nip of the downstream-side conveying roller pair 6, then the upstream-side separable roller pair 4 is closed at that point in time, so that the mail items M can be more reliably conveyed in a stable manner.

Furthermore, with the present embodiment, if the trailing edge in conveying direction of the mail item M passes the upstream-side separable roller pair 4 after the upstream-side separable roller pair 4 is closed, then it becomes immediately possible to hand over the next mail item M to the upstream-side separable roller pair 4, so that there is no necessity to widen the gap between the mail items M, and there is no necessity to branch the conveying path into two directions and to provide two gap correction apparatuses 50 in parallel, so that the installation space of the apparatus does not become large.

Figure 22:
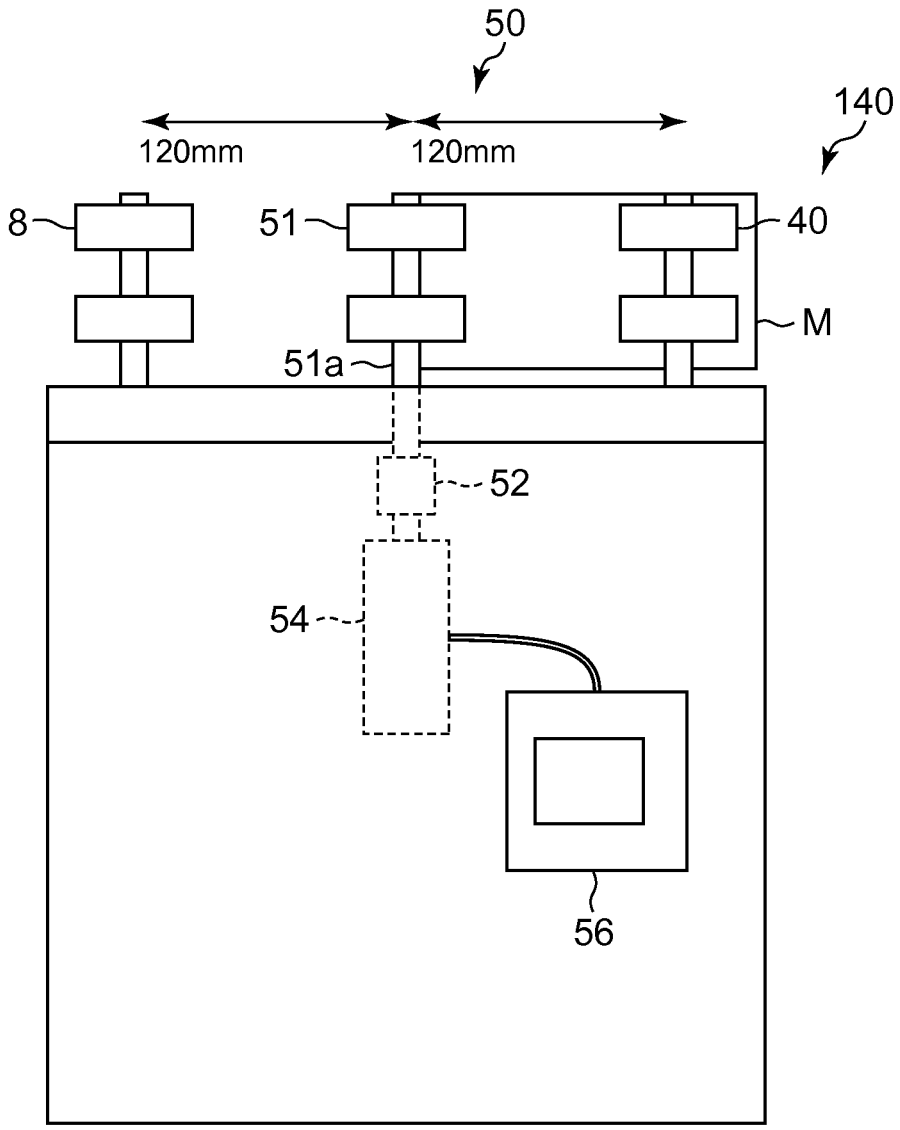
FIG. 22 is a diagrammatic view, viewed from the front, showing a mail handling apparatus according to a fifth embodiment.

FIG. 22 is a diagrammatic view, taken from the front, of a mail handling apparatus 140 (referred to below simply as "handling apparatus 140") according to the fifth embodiment. Other than being provided with an upstream-side conveying roller pair 8 at the position of the upstream-side separable roller pair 4 of the above-described handling apparatus 130 of the fourth embodiment and being newly provided with a downstream-side separable roller pair 40 at the position of the downstream-side conveying roller pair 6 of the above-described handling apparatus 130 of the fourth embodiment, the handling apparatus 140 of this embodiment has a structure that is substantially the same as that of the handling apparatus 130 of the fourth embodiment described above. Thus, structural elements having the same function as those in the handling apparatus 130 of the above-described fourth embodiment are assigned the same reference numerals and their further explanation has been omitted.

That is to say, a mail item M that is conveyed in the arrow direction T in the drawing on the conveying path 2 of the handling apparatus 140 is passed along the upstream-side conveying roller pair 8, the holding roller pair 51 of the gap correction apparatus 50, and the downstream-side separable roller pair 40 in that order.

It should be noted that the downstream-side separable roller pair 40 has substantially the same structure as the above-described upstream-side separable roller pair 4, and is opened and closed by a similar separating mechanism 20 (downstream-side separating mechanism) as in the above-described fourth embodiment. Moreover, also in the present embodiment, the distance between the nips of the roller pairs 8, 51 and 40 that are lined up along the conveying path 2 is set to 120 mm. That is to say, the length in conveying direction from the nip of the upstream-side conveying roller pair 8 to the nip of the downstream-side separable roller pair 40 is set to be shorter than twice the length in conveying direction of the shortest mail item Mmin.

Referring to FIG. 23, the following is an explanation of the operation of the handling apparatus 140 with the above-described structure. In the standby state before a mail item M is fed into the handling apparatus 140, the controller 30 closes the downstream-side separable roller pair 40 (state shown in FIG. 23A). Then, every time mail items M are conveyed on the conveying path 2, the controller 30 detects the length of each mail item M in conveying direction and the spacing (gap) between the mail items M, for example with the sensor S0 that is arranged upstream in conveying direction from the upstream-side conveying roller pair 8.

To detect the length of a mail item M, the controller 30 calculates the length of the mail item M in conveying direction based on the conveying speed of the mail item M and the time after the leading edge in conveying direction of the mail item M has passed the sensor S0 and the output from the sensor S0 has gone from light to dark, until the trailing edge in conveying direction of the mail item M has passed the sensor S0 and the output from the sensor S0 has gone from dark to light. Moreover, to detect a gap between mail items M, the controller 30 calculates the gap between mail items M based on the conveying speed of the mail items M and the time after the trailing edge in conveying direction of a preceding mail item M has passed the optical axis of the sensor S0 until the leading edge in conveying direction of the following mail item M passes the sensor S0.

Figure 23A:
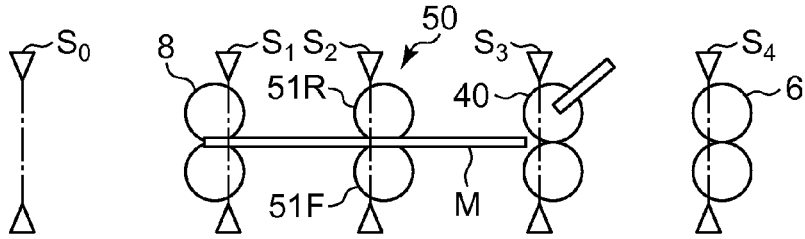
FIGS. 23A to 23E are operation diagrams illustrating the operation of the handling apparatus in FIG. 22.
Figure 23B:
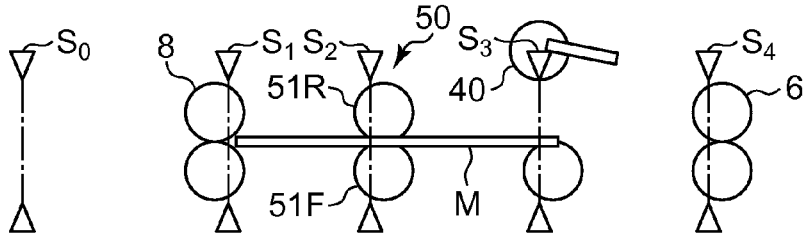
Figure 23C:
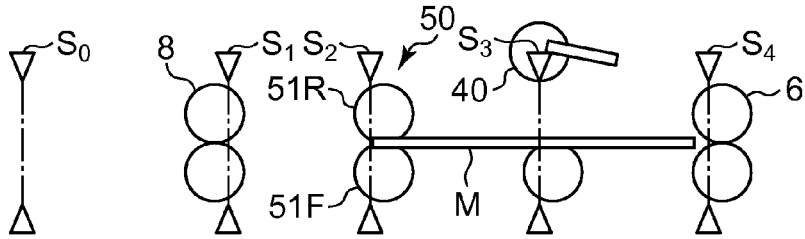

Then, when the leading edge in conveying direction of the conveyed mail item M passes the nip of the holding roller pair 51 of the gap correction apparatus 50 and reaches the nip of the downstream-side separable roller pair 40, and the optical axis of the sensor S3 is blocked, the controller 30 opens the downstream-side separable roller pair 40 to undertake a gap correction of the mail items M (state shown in FIG. 23B). Furthermore, at this time, the controller 30 monitors the output of the sensor S1, and taking the fact that the trailing edge in conveying direction of the mail item M has passed the nip of the upstream-side conveying roller pair 8 (state shown in FIG. 23B) as a trigger, the controller 30 starts the rotation control of the motor 54 of the holding roller 51F of the gap correction apparatus 50, so as to change the conveying speed of the mail item M.

The gap between the mail items M can be controlled by decelerating or accelerating the conveying speed of the mail items M. In the present embodiment, since the length of all conveyed mail items M in conveying direction as well as the length of the gaps has been detected in advance with the sensor S0, the gaps between the mail items M can be controlled to the desired value by accelerating or decelerating the motor 54 based on the length of the mail items M in conveying direction and the gap length.

Figure 23D:
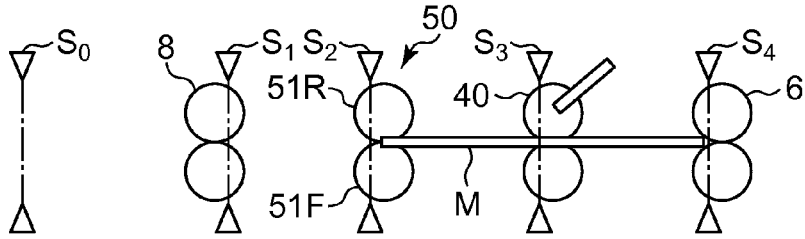
Figure 23E:
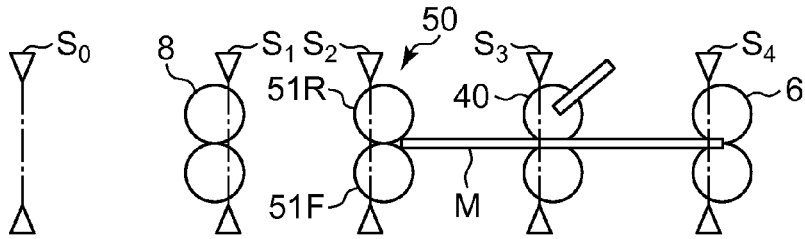

After this, the controller 30 monitors the output of the sensor S4 and closes the downstream-side separable roller pair 40, taking the fact that the leading edge in conveying direction of the mail item M has reached the nip of the downstream-side conveying roller pair 6 (state shown in FIG. 23D) or the fact that the gap correction control of the mail items M has finished as a trigger (state shown in FIG. 23D).

With the handling apparatus 140 of the present embodiment as described above, similar effects can be achieved as with the handling apparatus 110 of the above-described second embodiment. That is to say, the downstream-side separable roller pair 40 is opened at the point in time when the leading edge in conveying direction of the mail item M fed into the gap correction apparatus 50 has reached the nip of the downstream-side separable roller pair 40, so that when the gap correction of the mail item M is started, the conveying state of the mail item M can be stabilized, and a more precise gap correction becomes possible.

Moreover, with the present embodiment, since it is sufficient to make the simple configurational change of enabling opening and closing of the roller pair (the downstream-side separable roller pair 40 in the present embodiment) that is next to the gap correction apparatus 50 on the downstream side in conveying direction, a large-scale redesign of the apparatus is unnecessary, so that also the manufacturing costs of the apparatus can be kept low.

Moreover, with the present embodiment, if the gap correction of a mail item M is finished before sensing that the leading edge in conveying direction of the mail item M has reached the nip of the downstream-side conveying roller pair 6, then the downstream-side separable roller pair 40 is closed at that point in time, so that the mail items M can be more reliably conveyed in a stable manner.

Furthermore, with the present embodiment, if the trailing edge in conveying direction of the mail item M passes the holding roller pair 51 of the gap correction apparatus 50 after the downstream-side separable roller pair 40 is closed, then it becomes immediately possible to hand over the next mail item M to the holding roller pair 51, so that there is no necessity to widen the gap between the mail items M, and there is no necessity to branch the conveying path into two directions and to provide two gap correction apparatuses 50 in parallel, so that the installation space of the apparatus does not become large.

Figure 24:
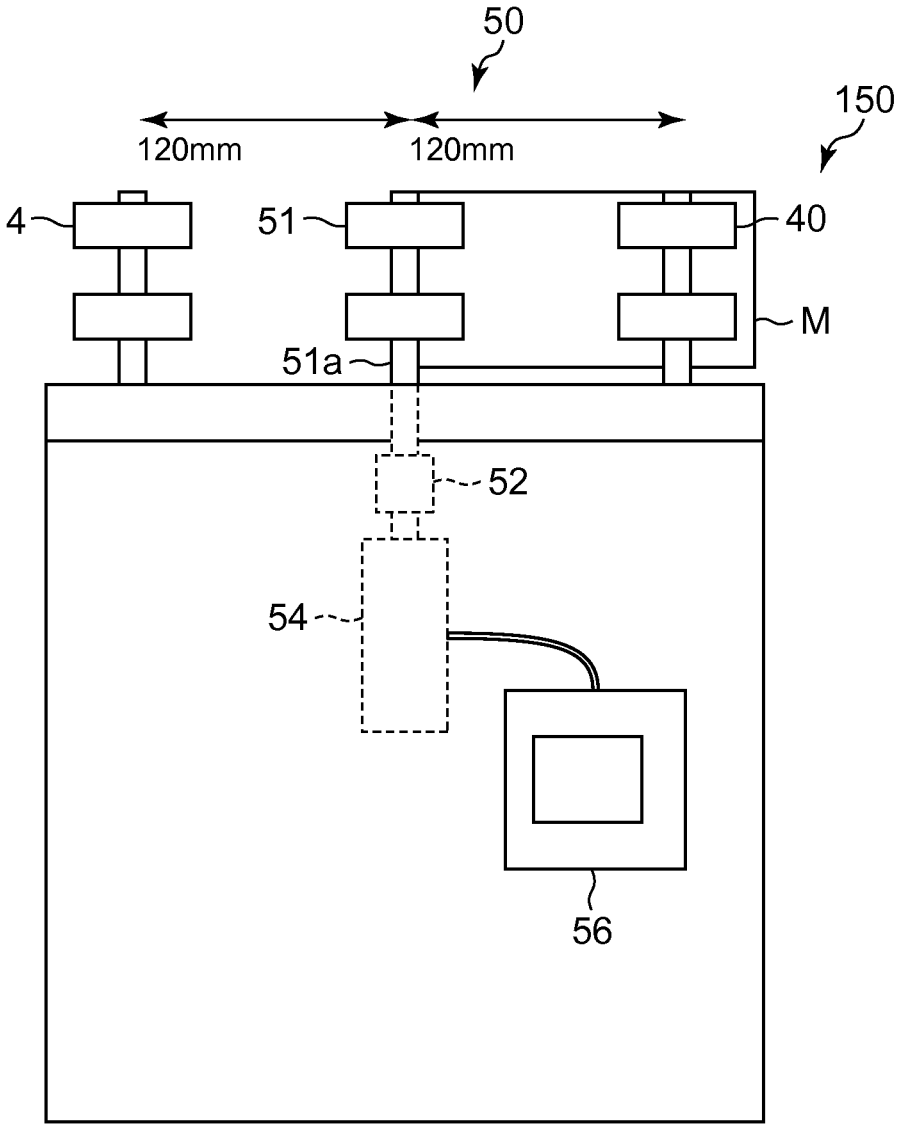
FIG. 24 is a diagrammatic view, viewed from the front, showing a mail handling apparatus according to a sixth embodiment.
Figure 25A:
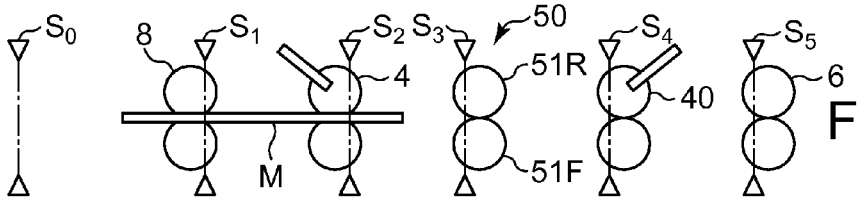
FIGS. 25A to 25G are operation diagrams illustrating a first operation example of the handling apparatus in FIG. 24.
Figure 25B:
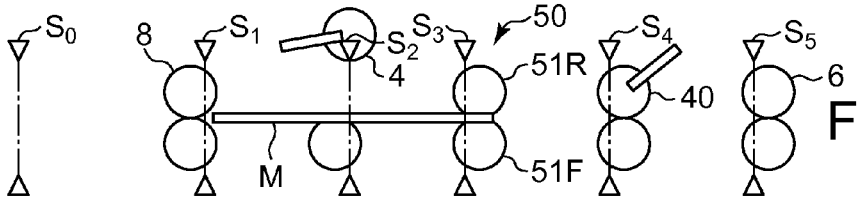
Figure 25C:
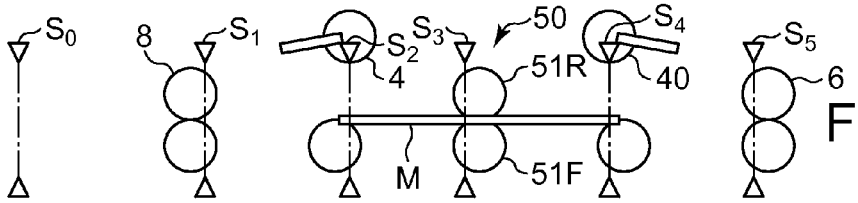
Figure 25D:
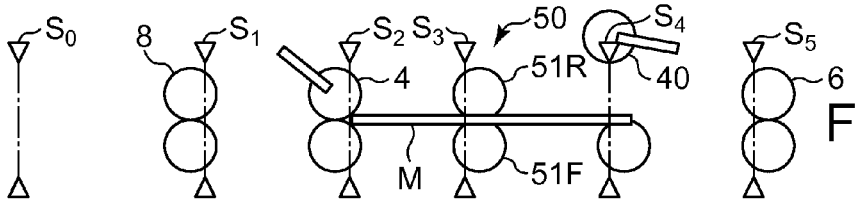
Figure 25E:
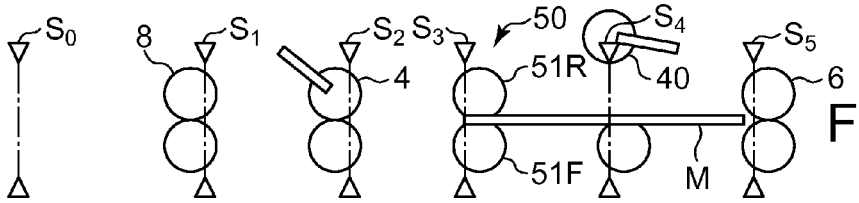
Figure 25F:
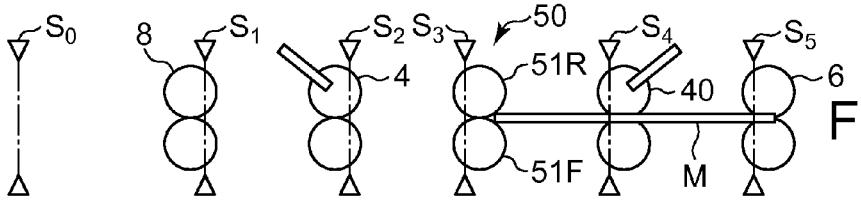
Figure 25G:
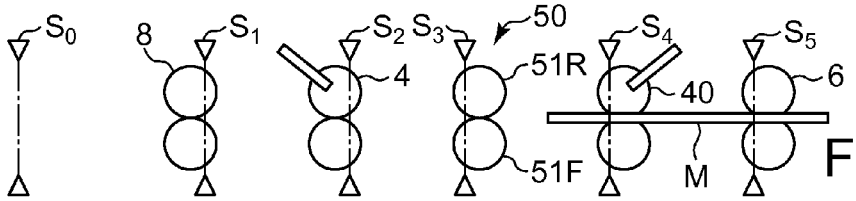
Figure 26A:
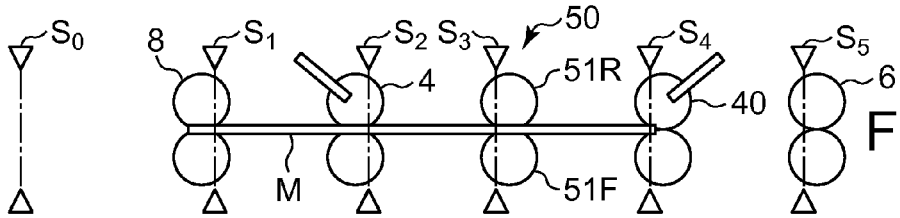
FIGS. 26A to 26E are operation diagrams illustrating a second operation example of the handling apparatus in FIG. 24.
Figure 26B:
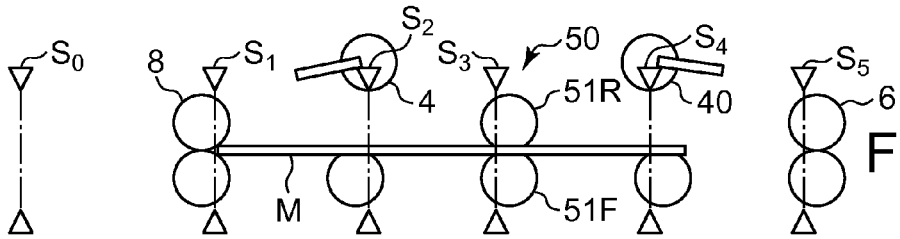
Figure 26C:
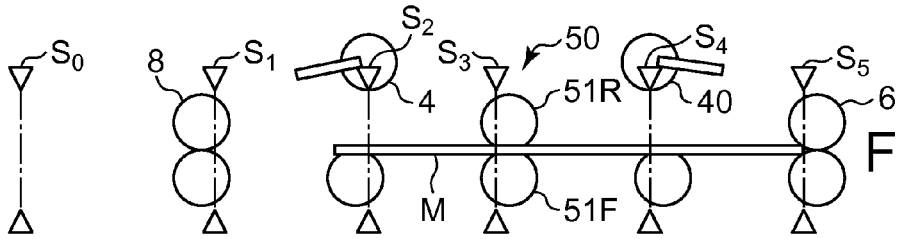
Figure 26D:
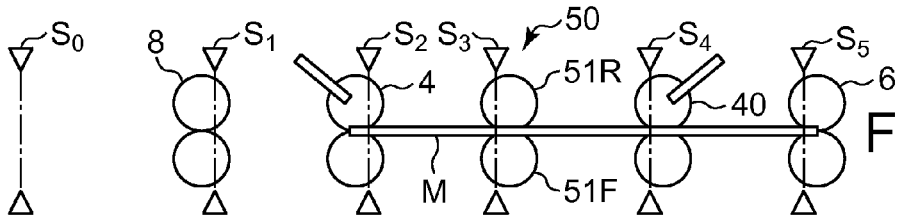
Figure 26E:
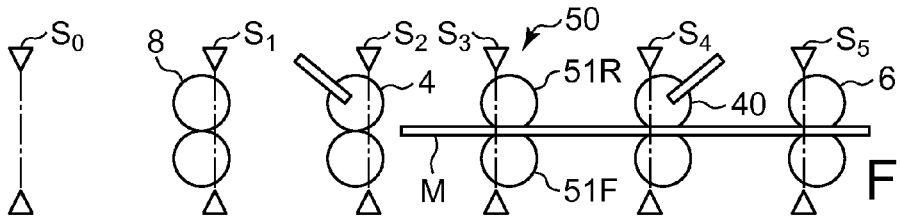

FIG. 24 is a diagrammatic view, taken from the front, of a mail handling apparatus 150 (referred to below simply as "handling apparatus 150") according to the sixth embodiment. This handling apparatus 150 has a structure combining the handling apparatus 130 of the fourth embodiment and the handling apparatus 140 of the fifth embodiment described above. That is to say, a mail item M that is conveyed on the conveying path 2 is passed along the upstream-side separable roller pair 4, the holding roller pair 51 of the gap correction apparatus 50, and the downstream-side separable roller pair 40 in that order.

The upstream-side separable roller pair 4 can be opened and closed by a separating mechanism 20 (here, referred to as "upstream-side separating mechanism 20U"), whereas the downstream-side separable roller pair 40 can be opened and closed by a separating mechanism 20 (here, referred to as "downstream-side separating mechanism 20D"). It should be noted that the length in conveying direction from the nip of the upstream-side separable roller pair 4 to the nip of the downstream-side conveying roller pair 6 is set to be shorter than three times the length of the shortest mail item Mmin in conveying direction. Here, the same reference numerals are assigned to structural elements having the same function as those in the handling apparatus 130 of the fourth embodiment or the handling apparatus 140 of the fifth embodiment described above, and their further explanation has been omitted.

Referring to FIGS. 25 and 26, the following is an explanation of several operation examples of the handling apparatus 150 of the present embodiment. First of all, as a first operation example, the case that a mail item M whose length in conveying direction is relatively short is conveyed and processed is explained with reference to FIG. 25. If the length of the mail item M conveyed on the conveying path 2 is detected with the sensor S0 and it is judged that that mail item M is a comparatively short mail item, then the controller 30 closes both the upstream-side separable roller pair 4 and the downstream-side separable roller pair 40 (state shown in FIG. 25A). When in this state, the leading edge in conveying direction of the mail item M conveyed in arrow direction T on the conveying path 2 passes the sensor S3 and the mail item M is fed into the gap correction apparatus 50 as shown in FIG. 25B, then the controller 30 opens the upstream-side separable roller pair 4 to undertake a gap correction operation for the mail item M.

After this, taking the fact that the trailing edge in conveying direction of the mail item M has passed the sensor S1 as a trigger (state shown in FIG. 25B), the controller 30 starts the gap correction operation for the mail item M. The gap correction operation for the mail item M continues until the leading edge in conveying direction of the mail item M is detected with the sensor S5 (state shown in FIG. 25F) or until the trailing edge in conveying direction of the mail item M has passed the sensor S3 (state shown in FIG. 25F).

In this situation, when the leading edge in conveying direction of the mail item M has reached the sensor S4, the controller 30 opens the downstream-side separable roller pair 40. Moreover, at the point in time when the gap correction operation for the mail item M has finished, the controller 30 closes the upstream-side separable roller pair 4 after the trailing edge in conveying direction of the mail item M has passed the sensor S2. Furthermore, at the point in time when the gap correction operation for the mail item M has finished, the controller 30 closes the downstream-side separable roller pair 40 after the trailing edge in conveying direction of the mail item M has passed the sensor S3.

Next, as a second operation example, the following is an explanation with reference to FIG. 26 of the case that a mail item M whose length in conveying direction is relatively long is conveyed and processed. If the conveyed mail item M is detected by the sensor S0 to be a relatively long mail item, then, as shown in FIG. 26A, the upstream-side separable roller 4 and the downstream-side separable roller pair 40 may be closed or they may be open. When the leading edge in conveying direction of the mail item M conveyed on the conveying path 2 passes the sensor S3 and is fed into the gap correction apparatus 50, then the controller 30 opens the upstream-side separable roller pair 4 and the downstream-side separable roller pair 40, to undertake a gap correction operation for the mail item M.

After this, the controller 30 monitors the output of the sensor S1, and judges whether the trailing edge in conveying direction of the mail item M has passed the nip of the upstream-side conveying roller pair 8. Then, when the output of the sensor S1 has gone from dark to light and it is judged that the trailing edge in conveying direction of the mail item M has passed the nip of the upstream-side conveying roller pair 8 (state shown in FIG. 26B), the controller 30 starts the gap correction operation for the mail item M.

The gap correction operation for the mail item M is continued until the leading edge in conveying direction of the mail item M has passed the sensor S5 and reaches the nip of the downstream-side conveying roller pair 6. Then, at the point in time when the leading edge in conveying direction of the mail item M has been detected by the sensor S5 and fed into the nip of the downstream-side conveying roller pair 6 (state shown in FIG. 26D), the controller 30 closes the upstream-side separable roller pair 4 and the downstream-side separable roller pair 40.

With the present embodiment as described above, similar effects can be achieved as with the above-described third embodiment.

While certain embodiments have been described, those embodiments have been presented by way of example only, and are not intended to limit the scope of the inventions. Indeed, the novel apparatuses described herein may be embodied in a variety of other forms; furthermore, various omissions, substitutions and changes in the form of the apparatuses described herein may be made without departing from the spirit of the inventions. The accompanying claims and their equivalents are intended to cover such forms or modifications as would fall within the scope and spirit of the inventions.

What is claimed is:

1. A sheet handling apparatus comprising:

a conveyor conveying a sheet;

a weight measuring apparatus measuring weight of the sheet fed by the conveyor into the weight measuring apparatus;

a separable roller pair that is arranged at a predetermined distance from the weight measuring apparatus on an upstream side in conveying direction, the separable roller pair including rollers having a nip therebetween and being adapted to hand over the sheet between the conveyor and the weight measuring apparatus by the nip of the rollers holding the sheet and rotating the rollers;

a separating mechanism configured to separate the separable roller pair; and a controller configured to control the separating mechanism, wherein the rollers of the separable roller pair separate from each other before weighing of the sheet is started by the weight measuring apparatus on the sheet being conveyed by the conveyor.

2. The apparatus according to claim 1, wherein the separable roller pair is arranged upstream and spaced apart from the weight measuring apparatus in the conveying direction, and the separable roller pair is designated as an upstream-side separable roller pair, the upstream-side separable roller pair is adapted to feed the sheet conveyed by the conveyor into the weight measuring apparatus by holding the sheet with the nip of the upstream-side separable roller pair and rotating the rollers of the upstream-side separable roller pair, and the controller is further configured to control the separating wherein the rollers of the upstream-side separable roller pair are separated before weighing of the sheet begins by the weight measuring apparatus on which the sheet is being conveyed by the conveyor.

3. The apparatus according to claim 2, further comprising:

an upstream-side conveying roller pair that is arranged on the upstream side in conveying direction and spaced from the upstream-side separable roller pair, and a downstream-side conveying roller pair having a nip that is arranged on the downstream side in conveying direction and spaced from the weight measuring apparatus;

wherein the weight measuring apparatus is adapted to start the weighing of the sheet after a leading edge of the sheet fed into the weight measuring apparatus has reached the weight measuring apparatus and a trailing edge of the sheet in conveying direction has left the nip of the upstream-side conveying roller pair, and to end the weighing of the sheet before the leading edge in conveying direction of the sheet reaches the nip of the downstream-side conveying roller pair.

4. The apparatus according to claim 3, wherein a length in conveying direction from the nip of the upstream-side conveying roller pair to the nip of the downstream-side conveying roller pair is longer than a length of the sheet being conveyed along the conveyor.

5. The apparatus according to claim 3, further comprising a gap correction apparatus to correct a gap between a plurality of the sheets that are conveyed consecutively on the conveying path.

6. The apparatus according to claim 5, wherein nips of adjacent roller pairs are spaced apart at a distance that is less than a minimum length corresponding to a shortest length of paper the sheet handling apparatus is configured to convey along the conveyor, and a distance between the nip of the upstream-side separable roller pair to the nip of the downstream-side conveying roller pair is shorter than twice the minimum length.

7. The apparatus according to claim 3, wherein nips of adjacent roller pairs are spaced apart at a distance that is less than a minimum length corresponding to a shortest length of paper the sheet handling apparatus is configured to convey along the conveyor, and a distance between the nip of the upstream-side separable roller pair to the nip of the downstream-side conveying roller pair is shorter than three times the minimum length.

8. A sheet handling apparatus comprising:

a conveyor conveying a sheet;

a weight measuring apparatus measuring weight of the sheet fed by the conveyor into the weight measuring apparatus;

an upstream-side separable roller pair that is arranged at a predetermined distance from the weight measuring apparatus on an upstream side in conveying direction, the upstream-side separable roller pair including rollers having a nip therebetween and being adapted to feed the sheet conveyed on the conveyor and the weight measuring apparatus by the nip of the rollers holding the sheet and rotating the rollers;

an upstream-side separating mechanism configured to separate the upstream-side separable roller pair;

a downstream-side separable roller pair that is arranged at a predetermined distance from the weight measuring apparatus on a downstream side in conveying direction, the downstream-side separable roller pair including rollers having a nip therebetween and being adapted to convey the sheet by the nip of the rollers holding the sheet fed from the weight measuring apparatus and rotating the rollers of the downstream-side separable roller pair;

a downstream-side separating mechanism configured to separate the downstream-side roller pair; and a controller configured to control the upstream-side separating mechanism and the downstream-side separating mechanism, wherein the rollers of the upstream-side separable roller pair are separated before weighing of the sheet is started by the weight measuring apparatus on the sheet being conveyed by the conveyor, and wherein the rollers of the downstream-side separable roller pair are brought into contact after weighing of the sheet by the weight measuring apparatus has finished.

9. The apparatus according to claim 8, further comprising:

an upstream-side conveying roller pair that is arranged on the upstream side in conveying direction and spaced from the upstream-side separable roller pair, and a downstream-side conveying roller pair having a nip that is arranged on the downstream side in conveying direction and spaced from the downstream-side separable roller pair, wherein the weight measuring apparatus is adapted to start the weighing of a sheet after a leading edge of the sheet fed into the weight measuring apparatus has reached the weight measuring apparatus and a trailing edge in conveying direction has left the nip of the upstream-side conveying roller pair, and to end the weighing of the sheet before the leading edge in conveying direction of the sheet reaches the nip of the downstream-side conveying roller pair.

10. The apparatus according to claim 9, further comprising a gap correction apparatus to correct a gap between a plurality of the sheets that are conveyed consecutively on the conveying path.

11. The apparatus according to claim 9, wherein nips of adjacent roller pairs are spaced apart at a distance that is less than a minimum length corresponding to a shortest length of paper the sheet handling apparatus is configured to convey along the conveyor, and a distance between the nip of the upstream-side separable roller pair to the nip of the downstream-side conveying roller pair is shorter than four times the minimum length.

12. The apparatus according to claim 8, wherein nips of adjacent roller pairs are spaced apart at a distance that is less than a minimum length corresponding to a shortest length of paper the sheet handling apparatus is configured to convey along the conveyor, and a distance between the nip of the upstream-side separable roller pair to the nip of the downstream-side conveying roller pair is shorter than three times the minimum length.

13. The apparatus according to claim 8, wherein nips of adjacent roller pairs are spaced apart at a distance that is less than a minimum length corresponding to a shortest length of paper the sheet handling apparatus is configured to convey along the conveyor, and a distance between the nip of the upstream-side separable roller pair to the nip of the downstream-side conveying roller pair is shorter than twice the minimum length.

14. The apparatus according to claim 8, wherein a length in conveying direction from the nip of the upstream-side conveying roller pair to the nip of the downstream-side conveying roller pair is longer than a length of the sheet being conveyed along the conveyor.

* * * * *